US006999710B2

(12) United States Patent
Kasahara

(10) Patent No.: US 6,999,710 B2
(45) Date of Patent: Feb. 14, 2006

(54) FIXING DEVICE WITH INTERMEDIATE TONER IMAGE TRANSFER MEDIUM

(75) Inventor: Nobuo Kasahara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/612,223

(22) Filed: Jul. 3, 2003

(65) Prior Publication Data

US 2004/0067081 A1 Apr. 8, 2004

(30) Foreign Application Priority Data

Jul. 4, 2002 (JP) ..... 2002-195596

(51) Int. Cl.
*G03G 15/20* (2006.01)
*G03G 15/16* (2006.01)

(52) U.S. Cl. ..... 399/329; 399/307

(58) Field of Classification Search ..... 399/302, 399/307, 308, 320, 321, 322, 328, 329, 400, 399/305

See application file for complete search history.

(56) References Cited

U.S. PATENT DOCUMENTS

| | | | | |
|---|---|---|---|---|
| 4,537,493 | A * | 8/1985 | Russel | 399/305 |
| 5,142,339 | A | 8/1992 | Kasahara et al. | |
| 5,436,647 | A | 7/1995 | Kasahara | |
| 5,561,506 | A | 10/1996 | Kasahara | |
| 5,585,598 | A | 12/1996 | Kasahara et al. | |
| 5,708,949 | A | 1/1998 | Kasahara et al. | |
| 5,752,148 | A * | 5/1998 | Yoneda et al. | 399/329 |
| 5,797,074 | A | 8/1998 | Kasahara et al. | |
| 5,815,784 | A | 9/1998 | Kasahara et al. | |
| 5,873,017 | A * | 2/1999 | Soga et al. | 399/302 |
| 5,953,567 | A | 9/1999 | Muramatsu et al. | |
| 5,960,246 | A | 9/1999 | Kasahara et al. | |
| 5,987,298 | A | 11/1999 | Muramatsu et al. | |
| 6,061,543 | A * | 5/2000 | Kayahara et al. | 399/302 |
| 6,112,046 | A | 8/2000 | Suzuki et al. | |
| 6,151,458 | A * | 11/2000 | Sato et al. | 399/322 X |
| 6,201,941 | B1 | 3/2001 | Kasahara et al. | |
| 6,212,351 | B1 * | 4/2001 | Kawagoe et al. | 399/302 |
| 6,351,619 | B1 * | 2/2002 | Yamada | 399/329 X |
| 6,393,241 | B1 | 5/2002 | Matsumoto et al. | |
| 6,526,246 | B2 | 2/2003 | Iwata et al. | |
| 6,542,707 | B2 | 4/2003 | Muramatsu et al. | |
| 6,571,076 | B2 | 5/2003 | Kasahara et al. | |
| 6,577,837 | B2 * | 6/2003 | Iida et al. | 399/307 |

(Continued)

FOREIGN PATENT DOCUMENTS

| | | |
|---|---|---|
| JP | 4-29177 | 1/1992 |

(Continued)

*Primary Examiner*—Sandra L. Brase
(74) *Attorney, Agent, or Firm*—Oblon, Spivak, McClelland, Maier & Neustadt, P.C.

(57) ABSTRACT

A fixing device for an image forming apparatus of the present invention includes a pressing/transferring member for pressing, when a toner image transferred from a photoconductive drum to a first image transfer body by primary image transfer is to be transferred to a second image transfer body by secondary image transfer, the second image transfer body against the first image transfer body. A heat-fixing member heats the second image transfer body after the secondary image transfer to thereby fix the transfer image on the second image transfer body. A press-fixing member presses the second image transfer body against the heat-pressing member. A belt conveyor conveys the second image transfer body from a nip for secondary image transfer between the first image transfer body and the pressing/transferring member to a nip for fixation between said heat-fixing member and the press-fixing member.

39 Claims, 15 Drawing Sheets

U.S. PATENT DOCUMENTS

| | | | | |
|---|---|---|---|---|
| 6,597,883 | B2 | 7/2003 | Muramatsu et al. | |
| 6,628,908 | B2 | 9/2003 | Matsumoto et al. | |
| 6,628,913 | B2 | 9/2003 | Matsumoto et al. | |
| 6,628,915 | B2 | 9/2003 | Muramatsu et al. | |
| 6,745,002 | B2 * | 6/2004 | Nakashima et al. | 399/307 |
| 2001/0041083 | A1 | 11/2001 | Terazawa et al. | |
| 2002/0044801 | A1 * | 4/2002 | Omata et al. | 399/309 |
| 2002/0051646 | A1 * | 5/2002 | Mochimaru et al. | 399/45 |

FOREIGN PATENT DOCUMENTS

| | | |
|---|---|---|
| JP | 9-114282 | 5/1997 |
| JP | 9-244430 | 9/1997 |
| JP | 9-329986 | 12/1997 |
| JP | 11-84899 | 3/1999 |
| JP | 2000-330397 | 11/2000 |
| JP | 2001-272866 | 10/2001 |
| JP | 2002-62701 | 2/2002 |

* cited by examiner

FIXING DEVICE WITH INTERMEDIATE TONER IMAGE TRANSFER MEDIUM

BACKGROUND OF THE INVENTION

1. Field of the Invention

The present invention relates to a fixing device configured to transfer a toner image from a photoconductive element to a sheet or recording medium and then fix the toner image on the sheet and an image forming apparatus and a color image forming apparatus including the same.

2. Description of the Background Art

It has been proposed to combine the function of a fixing device and the function of an image transferring device, which are included in an electrophotographic image forming apparatus, for implementing a simple configuration. Japanese Patent Laid-Open Publication No. 2000-242109, for example, discloses an image forming apparatus in which a roller, supporting a heat-resistant, image transfer body support belt, and a fixing roller, contacting the belt, each accommodate a heater therein while the belt effects image transfer and pressing at the same time. This apparatus, however, must heat the transfer body support belt for fixation and must cool off a photoconductive element in order to protect it from degeneration.

On the other hand, Japanese Patent Laid-Open Publication No. 2000-352879, for example, teaches an image forming apparatus in which an exciting coil is disposed in the loop of an intermediate image transfer belt, which turns in contact with a press roller and a photoconductive element, for heating magnetic metal forming the core of the belt by induction heating. In this case, the intermediate image transfer belt plays the role of an intermediate image transfer body and the role of a fixing belt at the same time. A problem with this apparatus is that there must be selected a material that satisfies both of the performance as an intermediate image transfer belt and the performance as a fixing belt. In addition, this apparatus is also required to heat the intermediate image transfer belt for fixation and to cool off the photoconductive element to protect it from degeneration.

Other image forming apparatuses of the type described are taught in, e.g., Japanese Patent Laid-Open Publication Nos. 9-15933, 9-114282, 10-63121, 10-307486 and 2000-275982. However, apparatuses taught in these documents, like the apparatus of Laid-Open Publication No. 2000-242109 mentioned earlier, each dispose a heater in a belt support roller and must therefore heat a belt and must cool a photoconductive element. This limits the allowable range of fixing conditions including nipping time and thereby makes it difficult to improve a margin as to fixation. Consequently, the kind of sheets applicable to the apparatus is limited while image quality is rendered unstable.

Further, when the intermediate image transfer belt plays the role of an intermediate transfer body and the role of a fixing belt at the same time, as taught in Laid-Open Publication No. 2000-352879, it is necessary to heat the intermediate transfer belt and to cool off the photoconductive element, making it difficult to maintain the surface of the belt uniform (removal of residual toner and impurities) This also makes the image quality unstable. In addition, it is likely that the entire apparatus becomes sophisticated and therefore high cost.

Technologies relating to the present invention are also disclosed in, e.g., Japanese Patent Laid-Open Publication Nos. 2000-330397, 2001-272866 and 2002-62701.

SUMMARY OF THE INVENTION

It is an object of the present invention to provide a fixing device capable of simplifying a fixing device and an image transferring device while insuring high image quality and an image forming apparatus and a color image forming apparatus including the same.

A fixing device of the present invention includes a pressing/transferring member for pressing, when a toner image transferred from a photoconductive drum to a first image transfer body by primary image transfer is to be transferred to a second image transfer body by secondary image transfer, the second image transfer body against the first image transfer body. A heat-fixing member heats the second image transfer body after the secondary image transfer to thereby fix the transfer image on the second image transfer body. A press-fixing member presses the second image transfer body against the heat-pressing member. A belt conveyor conveys the second image transfer body from a nip for secondary image transfer between the first image transfer body and the pressing/transferring member to a nip for fixation between said heat-fixing member and the press-fixing member.

An image forming apparatus and a color image forming apparatus each including the above fixing device are also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the present invention will be described hereinafter.

First Embodiment

Figure 1:
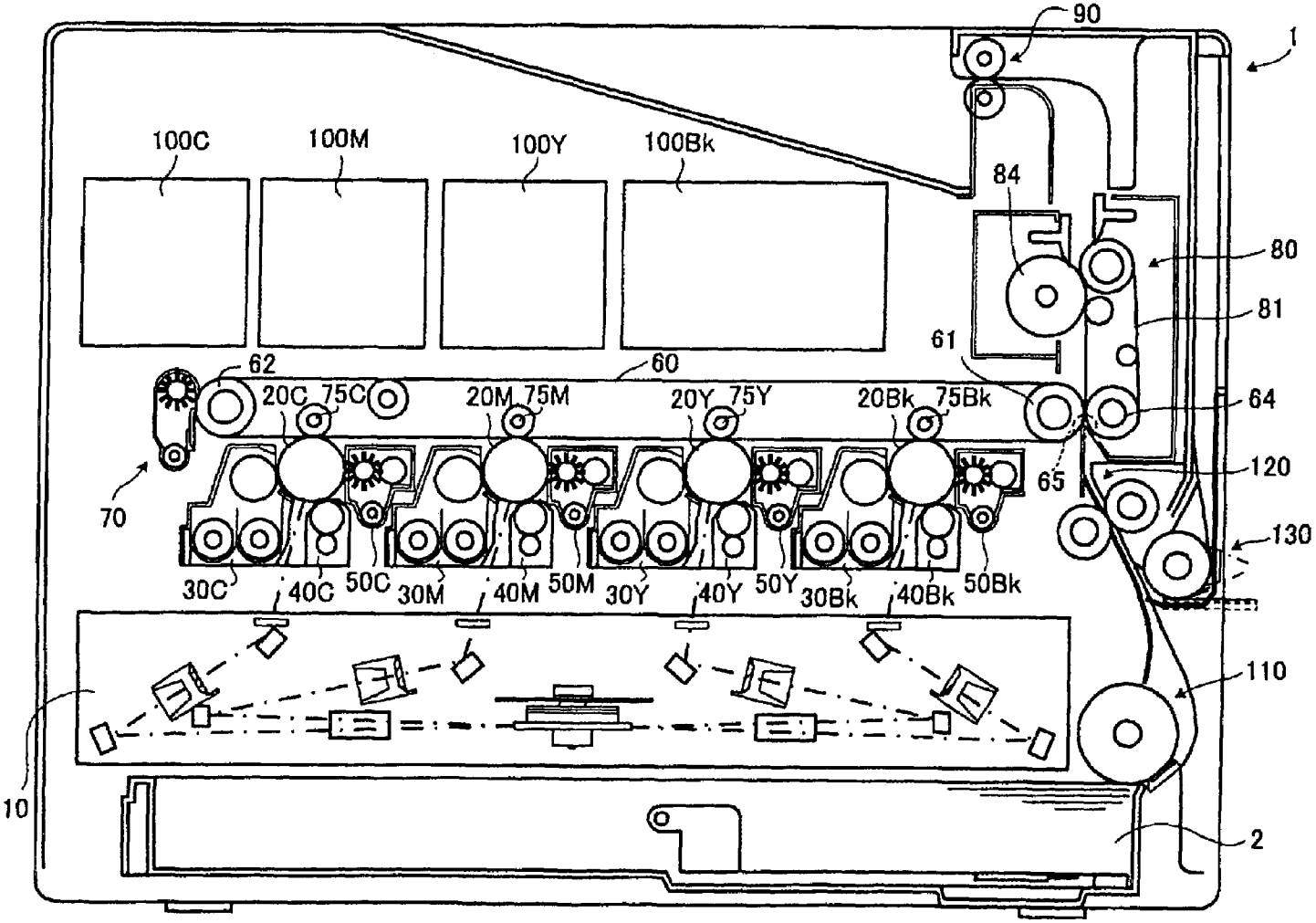
FIG. 1 is a section showing a first embodiment of the image forming apparatus in accordance with the present invention.

Referring to FIG. 1 of the drawings, an image forming apparatus embodying the present invention is shown and implemented as an electrophotographic, tandem color image forming apparatus by way of example. As shown, the image forming apparatus, generally 1, includes a plurality of (four in the illustrative embodiment) photoconductive drums or elements 20Y (yellow), 20M (magenta), 20C (cyan) and 20Bk (black). An optical writing unit or toner image forming means 10, which uses a laser in the illustrative embodiment, optically scans each of the drums 20Y through 20Bk in accordance with image data to thereby form a latent image. Chargers 40Y, 40M, 40C and 40Bk uniformly charge the surfaces of the drums 20Y, 20M, 20C and 20Bk, respectively.

Developing devices 30Y, 30M, 30C and 30Bk develop latent images formed on the drums 20Y, 20M, 20C and 20Bk with yellow, magenta, cyan and black toners, respectively. Cleaning units 50Y, 50M, 50C and 50Bk clean the surfaces of the drums 20Y, 20M, 20C and 20Bk, respectively. Primary image transfer rollers or devices 75Y, 75M, 75C and 75Bk respectively, sequentially transfer toner images formed on the drums 20Y, 20M, 20C and 20Bk to an endless, intermediate transfer belt or first image transfer body 60 one above the other, completing a color image on the belt 60 (primary image transfer hereinafter). A bias for image transfer is applied to each of the primary image transfer rollers 75Y through 75Bk.

The intermediate image transfer belt (simply belt hereinafter) 60 is passed over a drive roller 61, which forms part of secondary transferring means, and a driven roller 62 and other rollers. A secondary image transfer roller or pressing/transferring means 64 faces one of opposite ends of the belt 60 in the horizontal direction with the intermediary of a belt conveyor or supporting/conveying means 81. The secondary image transfer roller 64 additionally plays the role of attracting means, second transferring means and fixing roller. The drive roller 61 is configured to apply a bias for secondary image transfer to the belt 60. The lower run of the belt 60, as viewed in FIG. 1, is substantially flat, forming an image transfer surface. The drums 20Y through 20Bk face the flat lower run of the belt 60 and are arranged side by side in the direction in which the flat surface moves.

Figure 2:
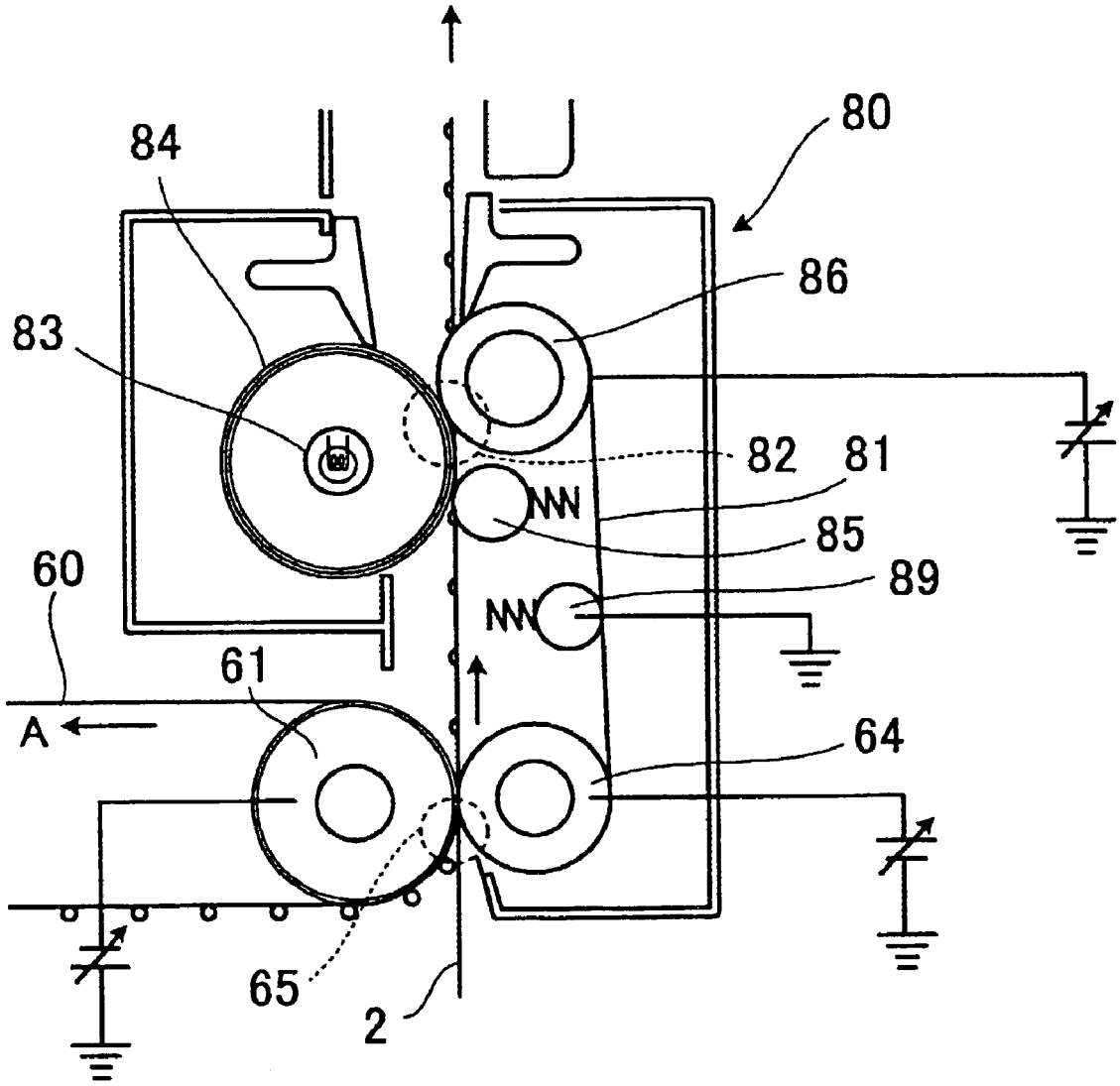
FIG. 2 is a fragmentary section showing a fixing device included in the first embodiment.

A sheet feeding device 110 and a fixing device or transferring/fixing means 80 are respectively positioned below and above the belt 60. A sheet turning device, not shown, is positioned at the opposite side to the belt 60 with respect to the secondary image transfer roller 64. In FIG. 2 showing the fixing device 80 in detail, a nip between the belt 60 and belt conveyor 81 is represented by a secondary image transfer position 65. At the secondary image transfer position 65, the full-color image is transferred from the belt 60 to a sheet or secondary image transfer body 2 (secondary image transfer hereinafter).

The belt 60 and an intermediate image transfer drum 60" (see FIG. 15) each are implemented as, e.g., a single layer of resin, a laminate of a cover layer and a core layer (taught in, e.g., Japanese Patent Laid-Open Publication No. 10-198182) or a laminate of a cover layer, an elastic layer and a core layer (taught in, e.g., Japanese Patent Laid-Open Publication No. 2001-312159) in accordance with the purpose.

A belt cleaning unit 70 removes toner left on the belt 60 after the image transfer.

The fixing device 80 fixes a toner image on the sheet 2 with heat and pressure and is, in the illustrative embodiment, constructed into a unit easy to maintain. As shown in FIG. 2, the fixing device 80 includes a heat roller or heat-fixing means 84 accommodating a heater or internal heating means 83 therein for heating the sheet 2 carrying the toner image thereon. The secondary image transfer roller 64, facing one end of the belt 60, presses the sheet 2 against the belt 60 and applies a bias for image transfer to the sheet 2 via the belt conveyor 81. A tension roller or grounding means 89 applies preselected tension to the belt 81 and is grounded to remove residual charges from the belt 81. A primary press roller 85 faces the heat roller 84. Also, a secondary press roller or press-fixing means 86, positioned downstream of the primary press roller 85 in the direction of sheet conveyance, faces the heat roller 84 and applies a bias to the sheet 2 via the belt conveyor 81. The primary and secondary press rollers 85 and 86 constitute a divided first roller in combination. The secondary press roller 86 additionally plays the role of attraction canceling means and bias applying means. The belt 81 is passed over the secondary image transfer roller 64, tension roller 89 and primary and secondary press rollers 85 and 86. A nip 82 for fixation is formed by part of the belt 81 passed over the heat roller 84 and primary and secondary press rollers 85 and 86.

In the illustrative embodiment, the heat roller 84 is implemented as a hollow, cylindrical metallic core coated with a heat-resistant resin layer or as a hollow, cylindrical metallic core on which a heat-resistant elastic layer and a heat-resistant resin layer are stacked in this order. With this configuration, the heat roller 84 obviates a sheet jam and creases for thereby stabilizing fixation.

The belt conveyor 81 may be implemented as, e.g., a single layer of polyimide or similar resin resistive to temperature of 160° C. or above, a laminate of a polyimide or similar heat-resistant resin layer and a Teflon or similar cover layer or a laminate of a core layer and a cover layer and an elastic layer sequentially stacked on the core layer in accordance with the purpose. With such a belt conveyor 81 sufficiently resistant to heat, it is possible to guarantee a sufficient nip time and to enhance conveyance quality during secondary image transfer and fixation, thereby obviating a sheet jam and creases.

The secondary image transfer roller 64 may be implemented as, e.g., a hollow metallic core formed of stainless steel (SUS) or similar metal on which an urethane or similar elastic layer, which has resistance controlled to about $10^6$ Ω to $10^{10}$ Ω by a conductive substance, is formed, a roller having rubber hardness (taught in, e.g., Japanese Patent Laid-Open Publication No. 10-240027) or a metallic roller.

Referring again to FIG. 1, a sheet discharging device 90 drives the sheet or print 2, coming out of the fixing unit 80, out of the apparatus to a print tray. Toner containers 100Y, 100M, 100C and 100Bk store yellow, magenta, cyan and black toners, respectively. It is to be noted that toners include those having low melting points. The sheet feeding device 110 pays out one sheet 2 from a sheet cassette and conveys it to a registration roller pair 120. The registration roller pair 120 positions the sheet 2 just before image transfer.

In the illustrative embodiment, the diameter of the drums 20Y through 20Bk and that of the drive/bias roller 61 are the same as each other or an integral multiple of each other. The drums 20Y through 20Bk are positioned at the same distance as each other, which is the same as the circumferential length of each drum. The circumferential length of the belt 60 is an integral multiple of the circumferential length of each of the drums 20Y through 20Bk. Why such dimensions are selected is that the diameter of the individual drum, the interval between nearby drums, the circumferential length of the belt 60 and the diameter of the drive/bias roller 61 have noticeable influence on the misregister of color images.

More specifically, when the dimensions mentioned above are selected, even if the drums 20Y through 20Bk and drive roller 61 each may be eccentric, a positional shift to occur for one rotation of the individual drum or the drive roller does not vary. This successfully prevents images of different colors transferred to the belt 60 from being shifted from each other.

Image transfer and fixation unique to the illustrative embodiment will be described more specifically hereinafter. The belt 60 is moving in contact with the drums 20Y through 20Bk in a direction indicated by an arrow A in FIG. 1 when toner images are formed on the drums 20Y through 20Bk. A bias for image transfer is applied to each of the primary image transfer rollers 75Y through 75Bk, which respectively face the drums 20Y through 20Bk, so that toner images are sequentially transferred from the drums 20Y through 20Bk to the belt 60 one above the other at consecutive primary image transfer positions, completing a color image on the belt 60. Toners left on the drums 20Y through 20Bk after the primary image transfer are removed by the cleaning units 50Y through 50Bk, respectively.

The top sheet 2 paid out from the sheet cassette is conveyed to the registration roller pair 120 by the sheet conveying device 110. The sheet 2 may be one fed from a manual sheet feeder 130 by hand. In any case, the registration roller pair 120 once stops the sheet 2 and then starts conveying it at preselected timing to the secondary image transfer position 65. At this instant, a particular bias is applied to each of the drive roller 61 and secondary image transfer roller 64, so that the color toner image is collectively transferred from the belt 60 to the sheet 2.

Because the toner image on the belt 60 is usually of negative polarity, a positive bias is applied to the secondary image transfer roller 64 in order to charge the reverse side of the sheet 2 to positive polarity. Also, the bias applied to the secondary image transfer roller 64 is so switched as to implement optimum image transfer in accordance with the image forming mode selected, e.g., a full-color or a monocolor mode as well as with the kind of the sheet 2 used. Further, to enhance transfer efficiency, the inner surface of the belt 60 may not be grounded, but may be applied with a negative bias.

The sheet 2, conveyed by the registration roller pair 120, reaches the secondary image transfer position or nip 65 via a substantially vertical path. When the sheet 2 moves away from the secondary image transfer position 65, it electrostatically adheres to the belt conveyor 81.

Toner left on part of the belt 60 moved away from the secondary image transfer position 65 is removed by the belt cleaning unit 70. At this instant, a discharging device, not shown, may discharges the belt 60, depending on the material of the belt 60.

The sheet 2, electrostatically adhering to the belt conveyor 81, is conveyed by the belt conveyor 81 to a nip for fixation 82 almost right above the secondary image transfer position 65. While the sheet 2 is being conveyed via the nip 82, the toner image on the sheet 2 is fixed by heat and pressure. The secondary press roller 86 is charged to negative polarity by a bias applied via the belt conveyor 81 and therefore discharges the sheet 2 and belt conveyor 81. The sheet 2 is then peeled off from the belt 81 by the secondary press roller 86 and then driven out to the print tray via the sheet discharging device 90. It is to be noted that the tension roller 89 maintains the belt 81 under preselected tension while discharging the belt 81 because the roller 89 is connected to ground.

In the illustrative embodiment, the sheet 2 is not conveyed by a long distance along the belt 81, but is driven out by the sheet discharging device 90 via the fixing unit 80 just after it has moved away from the secondary image transfer roller 64. This successfully reduces the length of the sheet conveyance path. Further, the sheet turning device is positioned at opposite side to the belt 60 with respect to the secondary image transfer roller 64, as stated earlier. Therefore, in a duplex print mode, the path along which the sheet 2, coming out of the fixing unit 80, should be again conveyed to the secondary image transfer position 65 can be shortened. Consequently, a so-called first print time necessary for the first sheet 2 to be paid out from the sheet cassette and then driven out by the sheet discharging device 90 can be reduced.

Figure 3:
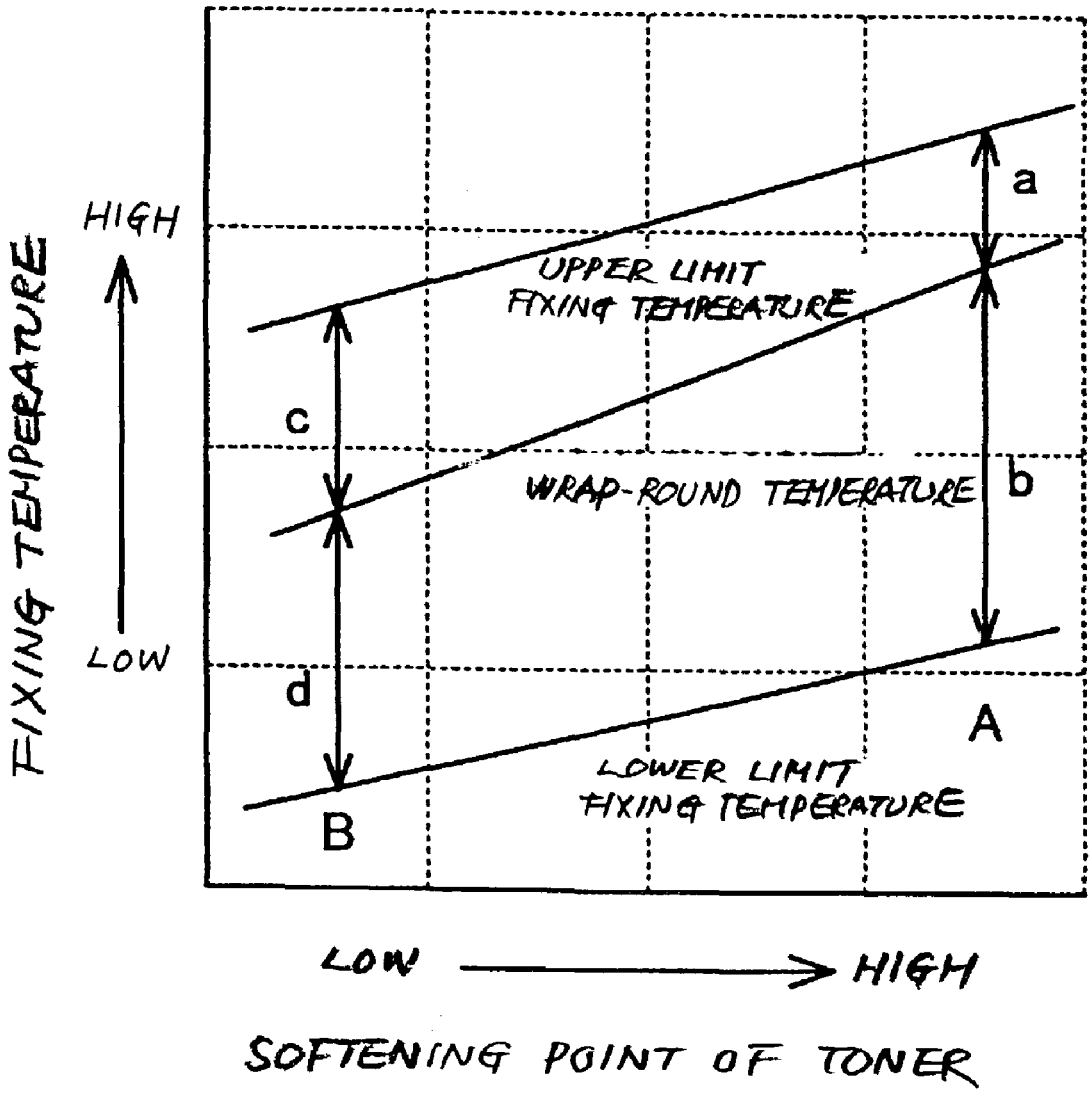
FIG. 3 is a graph showing a relation between fixing temperature and the softening point of toner.

Reference will be made to FIG. 3 for describing a relation between fixing temperature and the kind of toner, i.e., softening point of toner. In FIG. 3, the ordinate indicates fixing temperature, e.g., the surface temperature of a heat roller when a heat roller is used while the abscissa indicates the kind of toner. Also, in FIG. 3, lower limit fixing temperature refers to the lower limit of temperature allowable for fixation while upper limit fixing temperature refers to the upper limit of temperature that does not bring about hot offset during fixation. A wrap-round temperature refers to the upper limit of temperature that causes a sheet to wrap round a fixing roller, fixing belt or similar fixing member. Further, a fixing temperature width, i.e., the state-of-the-art practical range of fixing temperature is indicated by b and d. The broader the fixing temperature range, the more stable the fixation for various kinds of sheets and environmental temperature. Usually, the fixing temperature width ranges from 50° C. to 70° C. A difference, indicated by a and c, between the upper limit fixing temperature and the wrap-round temperature usually ranges from 20° C. to 40° C. although it depends on the toner, heat roller, belt material, fixing method and so forth.

If the wrap-round of a sheet can be obviated, then the fixing temperature width is noticeably broadened to (b+a) and (c+d). To implement low-temperature fixation for saving power, various attempts have heretofore been made to lower the softening point of toner, i.e., to realize toner having a low melting point. Adequate selection of resin for toner and the optimization of the distribution of toner molecular weights are essential for implementing such toner, as known in the art. Although toner having a low melting point (B, FIG. 3) lowers the lower limit fixing temperature, wrap-round temperature and upper limit fixing temperature more than the conventional toner (A, FIG. 3), such toner has a serious problem that the fixing temperature width is reduced.

In the illustrative embodiment, the sheet 2 is conveyed via the fixing section while electrostatically adhering to the belt conveyor 81 and then parted from the belt conveyor 81 and does not wrap round the heat roller 84 or a fixing belt, so that the fixing temperature width stated above can be noticeably broadened. Also, there can be obviated toner scattering, creasing, image blurring and running and other defects ascribable to irregularity in the position and the angle at which a sheet enters a nip for fixation as well as a jam, rubbing and other defects apt to occur when a sheet parts from a fixing roller or a fixing belt.

Further, because the sheet 2 does not wrap round the heat roller or fixing roller 84 or a fixing belt, the sheet 2 can be stably conveyed via the fixing station even when an image is formed over the entire surface of the sheet 2. Moreover, the sheet 2, electrostatically adhering to the belt conveyor 81, can be stably conveyed despite the substantially vertically extending path, so that the fixing unit can flexibly adapt to the configuration and size of a color image forming apparatus.

Japanese Patent Laid-Open Publication Nos. 10-207277, 11-133776 and 11-282295, for example, teach a fixing system using a fixing roller or a fixing belt and a pressing belt pressed against it for forming a nip for fixation. The fixing device 80, like such a fixing system, reduces thermal capacity required of the belt conveyor 81 and therefore reduces warm-up time and saves power.

Further, the illustrative embodiment increases the fixing temperature width, as stated earlier, and can therefore use toner having a low melting point. This lowers fixing temperature to thereby further reduce warm-up time and save power.

Moreover, a heater or similar heating means is not disposed in any one the secondary image transfer roller 64, secondary press roller 86 and other members positioned between opposite runs of the belt conveyor 71. Therefore, most heat generated by the heat roller 84 or a fixing belt is radiated via the belt conveyor 81 without being transferred to any one of the drums 20Y through 20Bk via the belt 60, so that the drums 20Y through 20Bk are not effected by the above heat. The adverse influence on the drums 20Y through 20Bk can also be obviated by use of toner having a low melting point.

With the construction described above, in the illustrative embodiment, the path extending from the secondary image transfer position to the fixing station does not include any step or gap to thereby enhance accurate conveyance of the sheet 2. Particularly, even a thin sheet or similar special sheet can be stably conveyed, so that a paper-free configuration is achieved. Because the sheet 2 is prevented from wrapping round the heat roller 84 or a fixing belt, there are obviated the limitation on the kind of a sheet ascribable to a jam and the need for a blank portion at the leading edge of a sheet. Further, there are obviated image defects, including blurring, toner scattering and running, during fixation. In addition, warm-up time and therefore power consumption is reduced.

Figure 4:
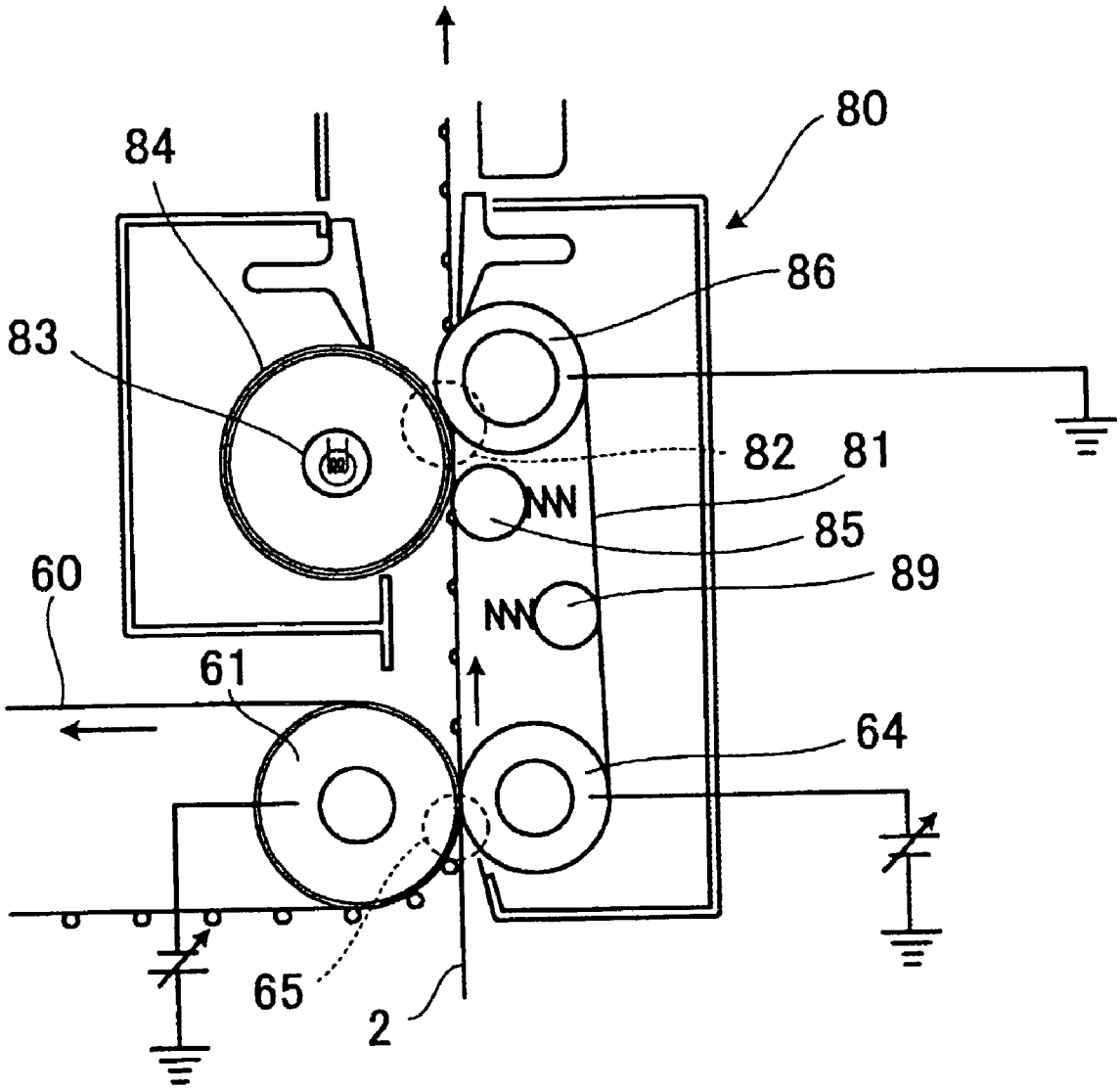
FIG. 4 is a fragmentary section showing a modified form of the fixing device of FIG. 3.

In the illustrative embodiment described above, the inner surface of the belt conveyor 81 is grounded via the tension roller 89 and secondary press roller 86. Alternatively, as shown in FIG. 4, the inner surface of the belt conveyor 81 maybe grounded via the secondary press roller 86 so as to further simplify the configuration of the fixing unit 80.

Second Embodiment

A second embodiment of the present invention will be described with reference to FIGS. 5 and 6. As shown, this embodiment differs from the first embodiment in that the secondary image transfer roller 64 is configured to selectively move the belt conveyor or endless belt 81 and belt 60 into or out of contact with each other and, in this sense, serves as moving means. Parts and elements identical with those of the first embodiment are designated by identical reference numerals and will not be described specifically in order to avoid redundancy. In the illustrative embodiment, the fixing device 80 is constructed into a unit easy to maintain.

Figure 5:
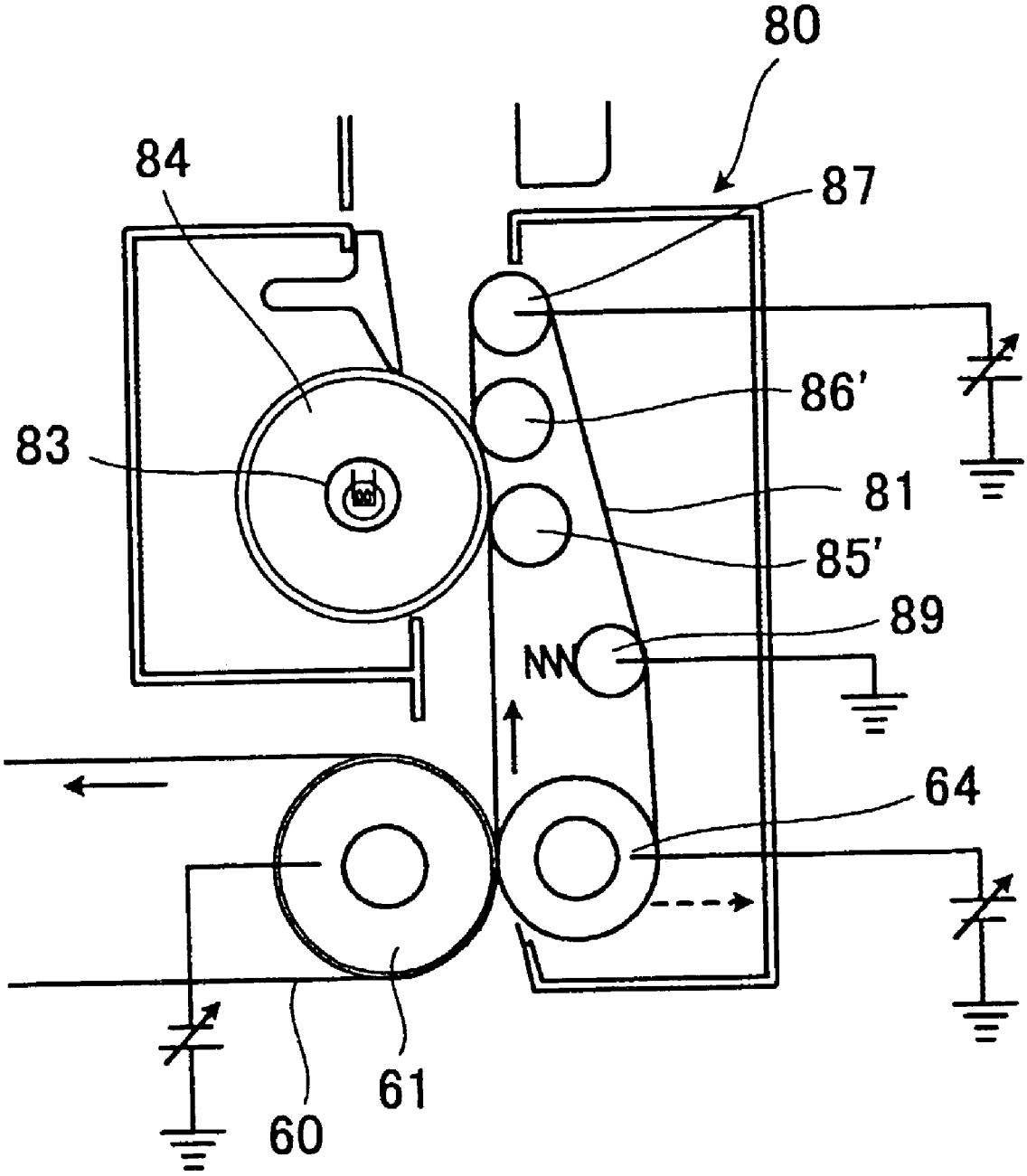
FIG. 5 is a fragmentary section showing a fixing device representative of a second embodiment of the present invention in an image forming condition.

As shown in FIG. 5, the fixing device 80 includes a primary press roller 85' corresponding to the roller 85, FIG. 2, and a secondary press roller 86' corresponding to the roller 86, FIG. 2, but smaller in diameter than the roller 86. A peel roller 87 is positioned downstream of the secondary press roller 86' in the direction of sheet conveyance, i.e., closer to the sheet discharging device 90, FIG. 1, than to the nip between the heat roller 84 and the roller 86'. The peel roller 87 is provided with a diameter of about 15 mm or below and configured to apply a negative bias opposite in polarity to the bias for secondary image transfer to the sheet 2 via the belt 81. The negative bias thus applied to the sheet 2 reduces the electrostatic adhesion of the sheet 2 derived from the positive bias, which is applied from the secondary image transfer roller 64 to the sheet 2 via the belt 81. This, coupled with the curvature of the peel roller 87, surely peels off the sheet 2 from the belt 81.

In the illustrative embodiment, a thin sheet, among others, can be stably conveyed. When the diameter of the peel roller 87 is about 12 mm or below, only the peel roller 87 is grounded. This alternative configuration is as advantageous as the configuration of FIGS. 5 and 6, as determined by experiments.

Figure 6:
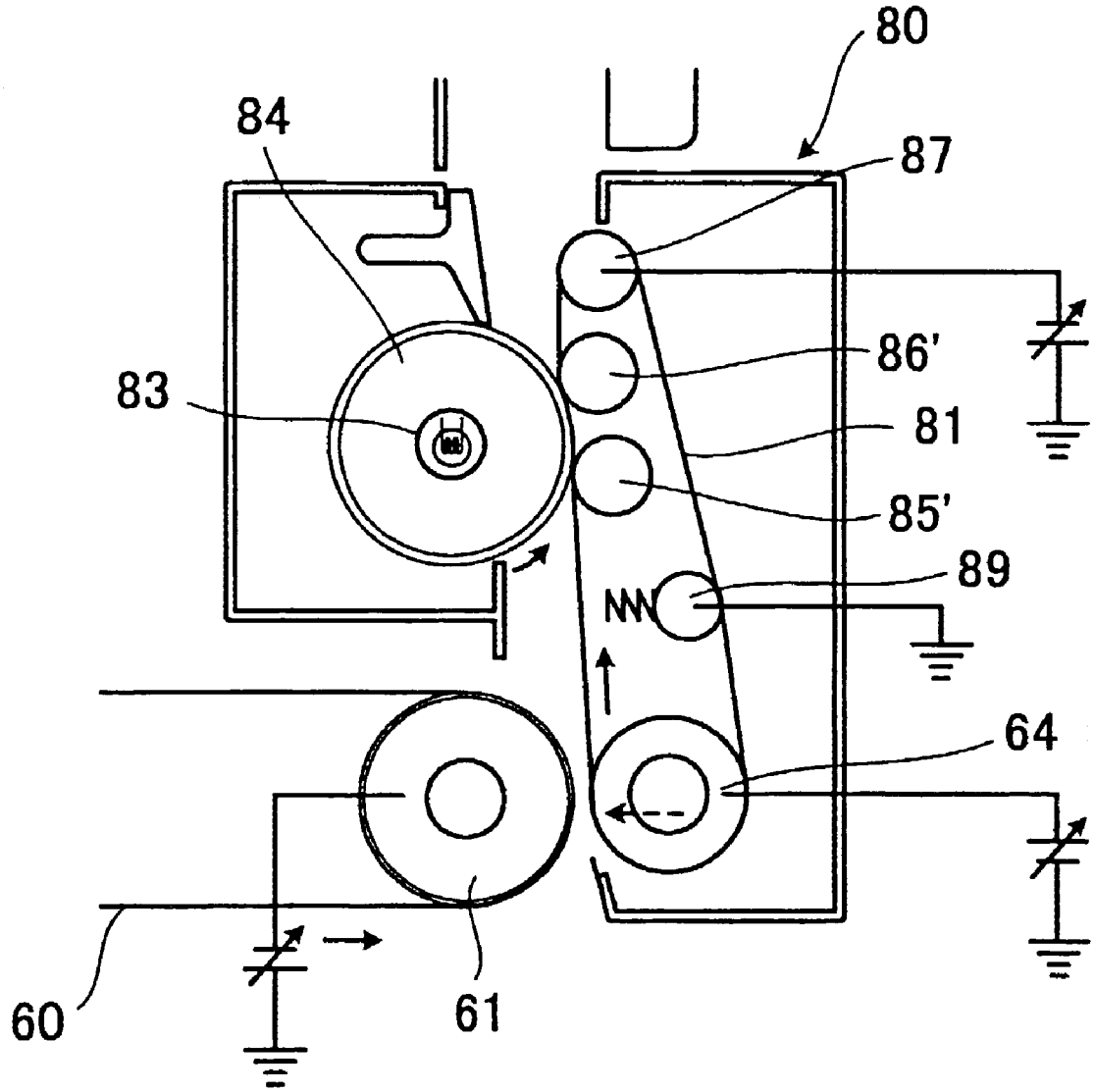
FIG. 6 is a view similar to FIG. 5, showing the fixing device in a fixing condition.

A solenoid or similar actuating means, not shown, moves the shaft of the secondary image transfer roller 64 in the right-and-left direction, as viewed in FIGS. 5 and 6, such that the belt conveyor 81 is movable into or out of contact with the belt 60. In FIG. 5, the belt conveyor 81 is shown as contacting the belt 60 and being movable in a direction indicated by a dotted arrow. In FIG. 6, the belt conveyor 81 is shown as being spaced from the belt 60 and being movable in a direction indicated by a dotted arrow. With this configuration, it is possible to interrupt heat transfer from the belt conveyor 81 to the belt 60 during the warm-up of the heat roller 84 or that of a fixing belt (see FIG. 7). This prevents heat for fixation from leaking and thereby reduces a warm-up time, i.e., a period of time necessary for the heat roller 84 or the fixing belt to reach preselected fixing temperature. After the heat roller 84 or the fixing belt has reached the preselected fixing temperature, the belt conveyor 81 is again brought into contact with the belt 60, as shown in FIG. 5.

Generally, a photoconductive element is likely to suffer from damage when heated to 50° C. or above and must therefore be maintained below 50° C. at all times. In the illustrative embodiment, the conveyor belt 81 is released from the belt 60 except when fixation is under way with the heat roller 84 being heated to 50° C. or above. It is therefore possible to protect the drums 20Y through 20Bk from heat otherwise transferred via the belts 81 and 60 without resorting to any special cooling means. Further, the belt conveyor 81 is warmed while conveying the sheet 2 from the secondary image transfer nip to the fixation nip, so that residual heat is expected to reduce the warm-up time. This selective contact scheme is similarly applicable to the other embodiments of the present invention as well.

Again, the belt conveyor 81 is implemented as a single layer of polyimide or similar resin resistive to heat of 160° C. or above, a laminate of polyimide or similar heat-resistant resin and a Teflon or similar cover layer or a laminate of a cover layer, an elastic layer and a core layer. Also, the heat roller 84 comprises a hollow, cylindrical, metallic core covered with a heat-resistant resin layer or a core on which a heat-resistant elastic layer and a heat-resistant resin layer are sequentially stacked.

Third Embodiment

Figure 7:
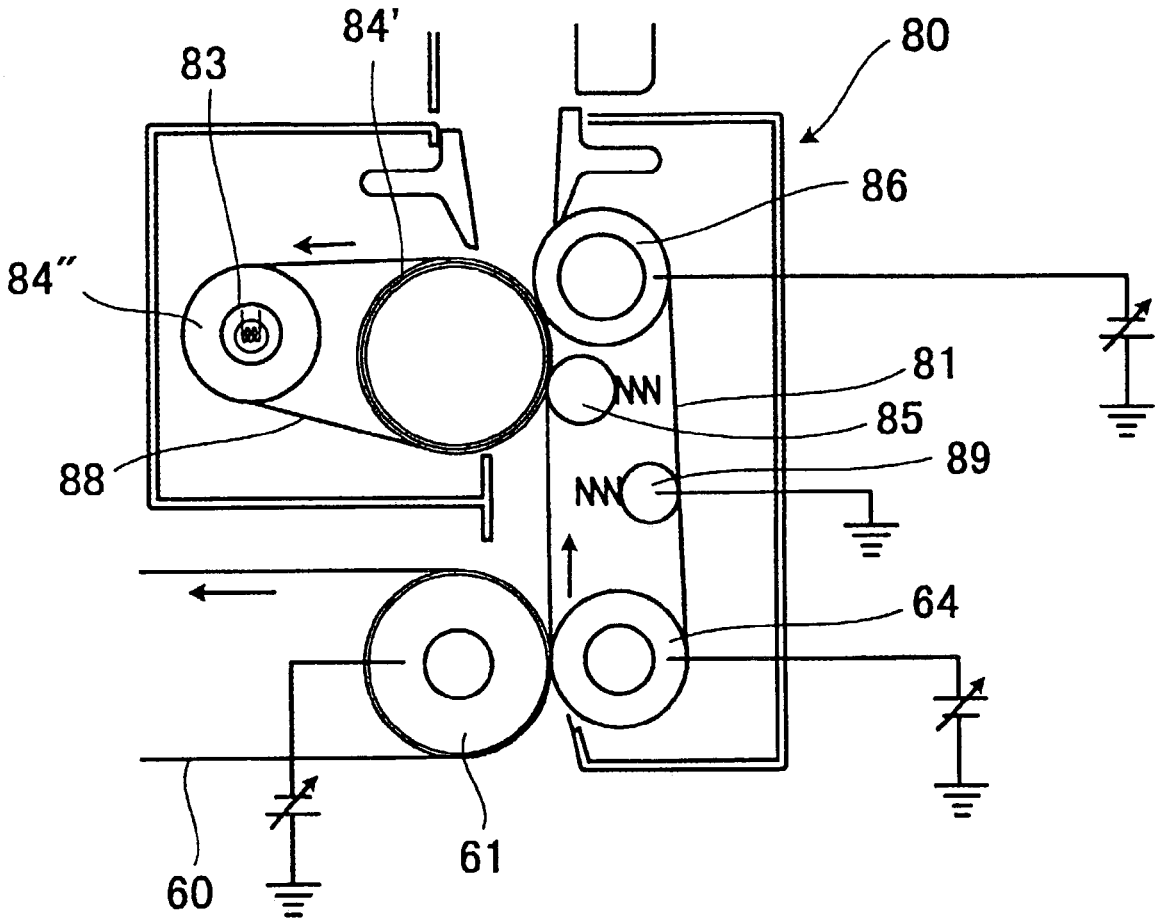
FIG. 7 is a fragmentary section showing a fixing device representative of a third embodiment of the present invention.

FIG. 7 shows a third embodiment of the present invention identical with the first embodiment except for the following. As shown, a fixing belt 88 is passed over a plurality of rollers, i.e., a fixing roller 84' and a heat roller or another fixing 84" in the illustrative embodiment. Parts and elements identical with those of the first embodiment are designated by identical reference numerals and will not be described specifically in order to avoid redundancy. Again, the fixing device 80 is constructed into a unit easy to maintain.

The fixing belt 88 is substituted for the heat roller 84, FIG. 2, and held in contact with the belt conveyor 81. The heat roller 84" accommodates a heater 83 therein. The fixing belt 88, which does not include a heater, should only have smaller thermal capacity than the heat roller 84 and therefore reduces warm-up time. For example, while the minimum wall thickness of the core of the heat roller 84 is about 0.3 mm when the core is formed of iron, the fixing belt 88 of the illustrative embodiment is only about 0.1 mm thick.

Again, the belt conveyor 81 is implemented as a single layer of polyimide or similar resin resistive to heat of 160° C. or above, a laminate of polyimide or similar heat-resistant resin layer and a Teflon or similar cover layer or a laminate of a cover layer, an elastic layer and a core layer. The fixing belt 88 is similar in structure to the conveyor belt 81 and passed over each roller by a particular angle.

Fourth Embodiment

Figure 8:
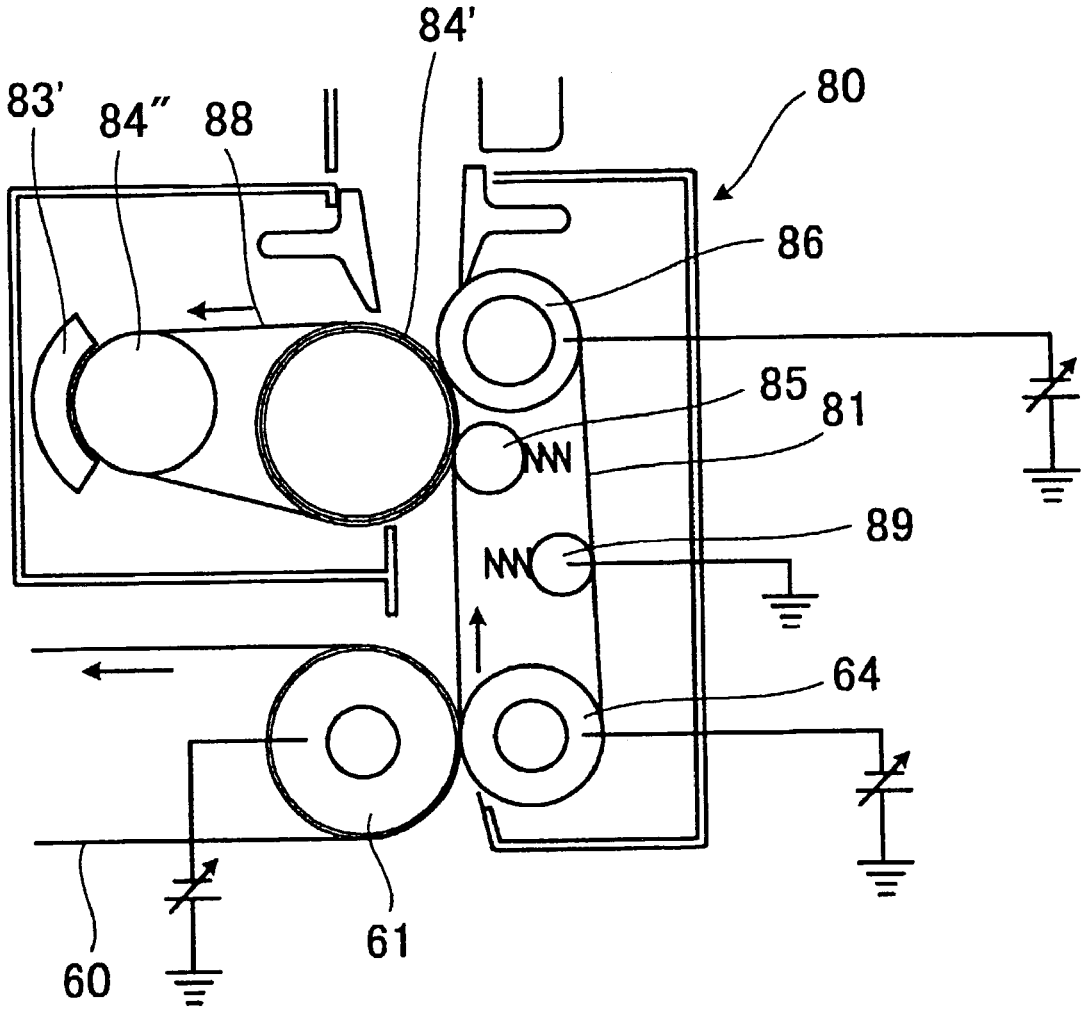
FIG. 8 is a fragmentary section showing a fixing device representative of a fourth embodiment of the present invention.

Reference will be made to FIG. 8 for describing a fourth embodiment of the present invention. This embodiment is identical with the third embodiment except that an induction heating member or external heating means 83' is positioned outside of the heat roller 84". This embodiment is identical with the first embodiment except for the fixing device 80. Parts and elements identical with those shown in FIG. 1 are designated by identical reference numerals and will not be described specifically in order to avoid redundancy. The fixing device 80 is constructed into a unit easy to maintain.

The fixing belt 88 passed over the heat roller 84" and fixing roller 84' contacts the conveyor belt 81, forming the nip for fixation. At this nip position, the fixing roller 84' and primary and secondary press rollers 85 and 86 face each other, so that a sheet is nipped from the position of the press roller 85 to the position of the press roller 86. The induction heating member 83' includes an exciting coil for heating magnetic metal, which constitutes the fixing belt 88, by induction heating. Induction heating enhances efficient heat conversion more than a halogen heater or similar heater and reduces the warm-up time because it directly heats the fixing belt 88.

Again, the belt conveyor 81 is implemented as a single layer of polyimide or similar resin resistive to heat of 160° C. or above, a laminate of polyimide or similar heat-resistant resin layer and a Teflon or similar cover layer or a laminate of a cover layer, an elastic layer and a core layer. The fixing belt 88 is similar in structure to the conveyor belt 81 and passed over each roller by a particular angle.

Fifth Embodiment

Figure 9:
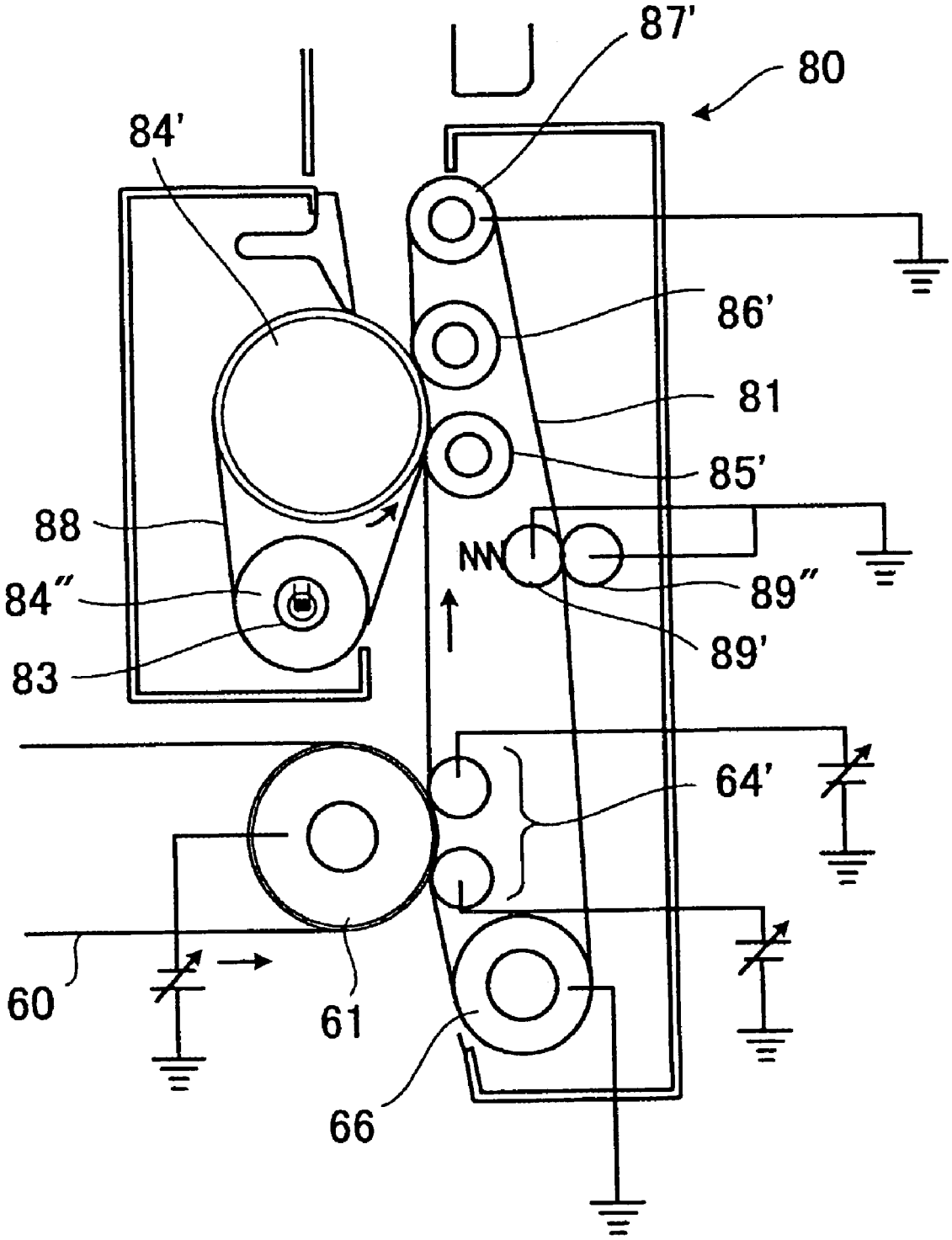
FIG. 9 is a fragmentary section showing a fixing device representative of a fifth embodiment of the present invention.

FIG. 9 shows a fifth embodiment of the present invention. This embodiment is identical with the fourth embodiment except that the belt conveyor 81 is passed over the primary and secondary press rollers 85' and 86', a divided, secondary image transfer roller or second roller 64, and a peel roller or third roller positioned downstream of the secondary press roller 86' in the direction of sheet conveyance, and that the diameter of the peel roller 87' is selected to be 12 mm or below. In addition, rollers, constituting the divided secondary image transfer roller 64', both face the belt 60. This embodiment is identical with the first embodiment except for the fixing device 80. Parts and elements identical with those shown in FIG. 1 are designated by identical reference numerals and will not be described specifically in order to avoid redundancy. The fixing device 80 is constructed into a unit easy to maintain.

As shown in FIG. 9, the heat roller 84", accommodating the heater 83, is positioned upstream of the fixing roller 84' in the direction of sheet conveyance. The fixing belt 88 is passed over the two rollers 84" and 84' as in the fourth embodiment. The fixing belt 88 moves in the up-and-down direction, as viewed in FIG. 9, generally in parallel to the belt conveyor 81 and is heated by the heater 83 at a position just preceding the nip between the belts 81 and 88. A sheet is therefore heated by the fixing belt 88 before it enters the nip for fixation, so that toner can be efficiently fixed on the sheet.

The two rollers, constituting the secondary image transfer roller 64', are spaced from each other by a preselected distance and held in contact with the belt 60 so as to nip a sheet. The secondary image transfer roller 64' is configured to apply a positive bias to the inner periphery of the belt conveyor 81 at the time of secondary image transfer. The secondary image transfer roller 64' may comprise a core formed of stainless steel (SUS) or similar metal and an urethane or similar elastic layer covering the core and having resistance controlled to $10^6$ Ω to $10^{10}$ Ω by a conductive substance, a roller having rubber hardness (taught in, e.g., Laid-Open Publication No. 10-240027 mentioned earlier) or a roller formed of metal. It is to be noted that by increasing the nip at the secondary image transfer position 65, it is possible to enhance efficient secondary image transfer.

A roller 66, supporting the conveyor belt 81, is positioned upstream of the secondary image transfer roller 64' in the direction of sheet conveyance. The belt conveyor 81 extends from the roller 66 to the peel roller 87'. Tension rollers 89' and 89" apply preselected tension to the belt conveyor 81 and are grounded for removing residual charges from the belt conveyor 81. In this sense, the tension rollers 89' and 89" play the role of ground rollers. Further, a cleaning device for cleaning the belt conveyor 81 and tension roller 89" is provided although not shown specifically, increasing the durability of the belt 81 and roller 89".

Again, the belt conveyor 81 is implemented as a single layer of polyimide or similar resin resistive to heat of 160° C. or above, a laminate of polyimide or similar heat-resistant resin layer and a Teflon or similar cover layer or a laminate of a cover layer, an elastic layer and a core layer. The fixing belt 88 is similar in structure to the conveyor belt 81 and passed over each roller by a particular angle.

Sixth Embodiment

Figure 10:
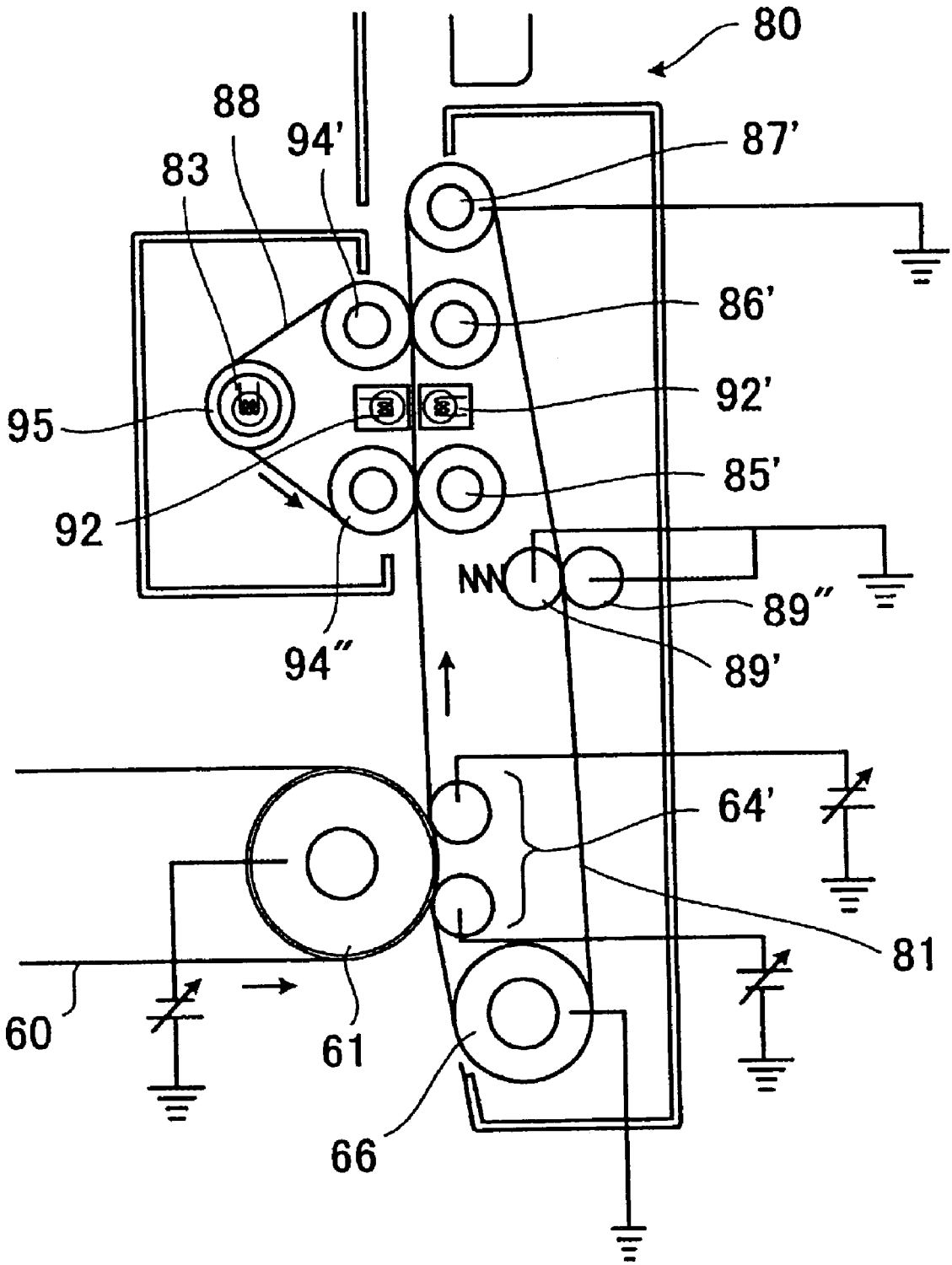
FIG. 10 is a fragmentary section showing a fixing device representative of a sixth embodiment of the present invention.

FIG. 10 shows a sixth embodiment of the present invention different from the fifth embodiment in that an auxiliary heater or endless belt heating means 92' heats the belt conveyor 81 around the primary and secondary press rollers 85' and 86'. This embodiment is identical with the first embodiment except for the fixing device 80. Parts and elements identical with those shown in FIG. 1 are designated by identical reference numerals and will not be described specifically in order to avoid redundancy. The fixing device 80 is constructed into a unit easy to maintain.

As shown in FIG. 10, the fixing belt 88 is passed over fixing rollers 94' and 94" and a heat roller 95, which accommodates the heater 83. The fixing roller 94' and secondary press roller 86' and the fixing roller 94" and primary press roller 85' face each other. The fixing belt 88 contacts the belt conveyor 81 from the position of the fixing roller 94" to the position of the fixing roller 94', forming a continuous nip over the interval between the two fixing rollers 94' and 94". Another auxiliary heater 92 is positioned inside the loop of the fixing belt 88 in order to directly heat the fixing belt 88. Likewise, the auxiliary heater 92' is positioned inside the loop of the belt conveyor 81 in order to directly heat the belt conveyor 81.

The continuous nip, extending from the position between the two rollers 94' and 86' to the position between the two rollers 94" and 85', obviates a difference in speed between the front and reverse sides of a sheet being conveyed, insuring uniform fixation even when the sheet is, e.g., thick. In addition, the two auxiliary heaters or external heating means 92 and 92', respectively heating the two belts 88 and 81, increase fixing speed.

Again, the belt conveyor 81 is implemented as a single layer of polyimide or similar resin resistive to heat of 160° C. or above, a laminate of polyimide or similar heat-resistant resin layer and a Teflon or similar cover layer or a laminate of a cover layer, an elastic layer and a core layer. The fixing belt 88 is similar in structure to the conveyor belt 81 and passed over each roller by a particular angle.

Seventh Embodiment

Figure 11:
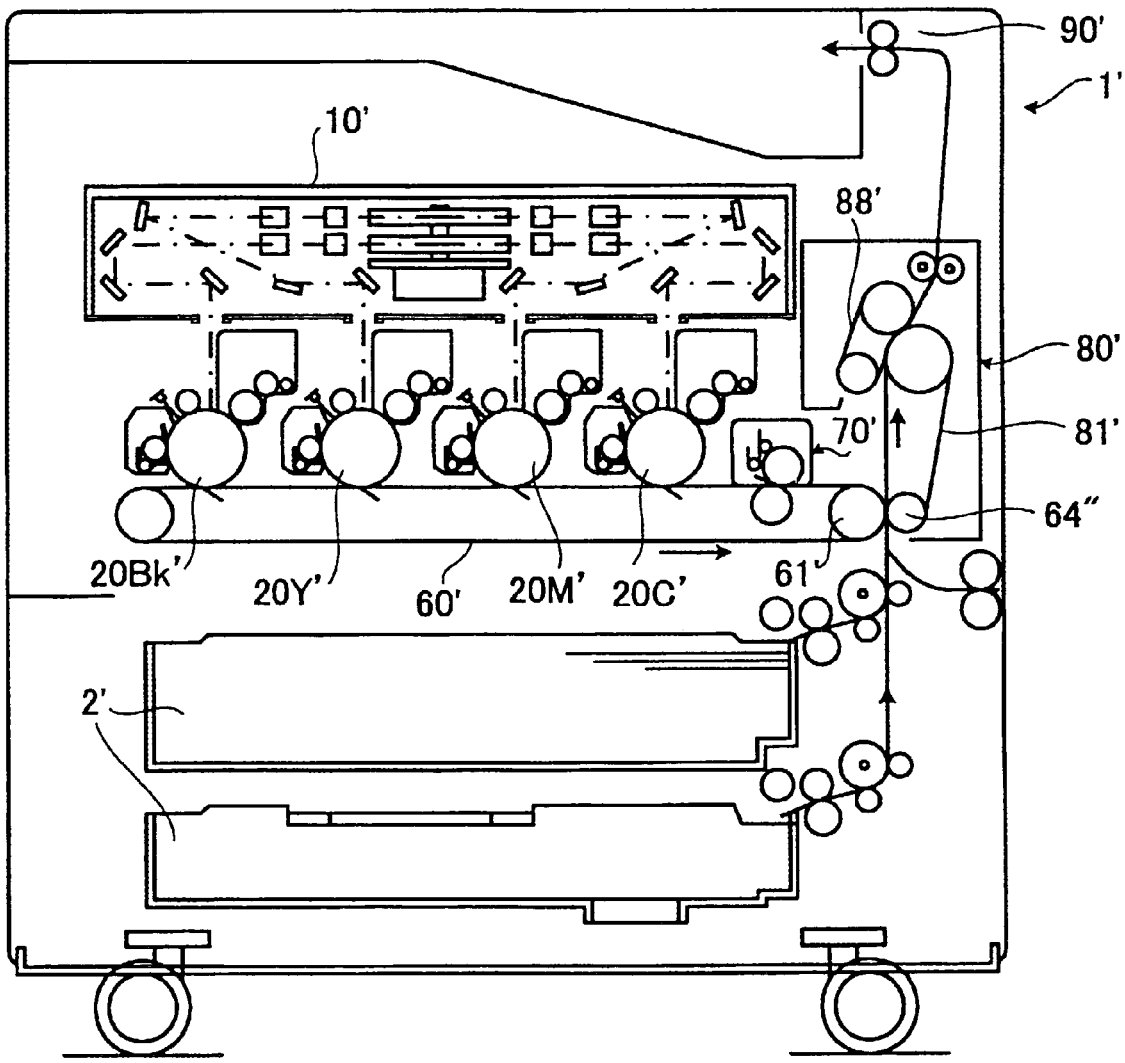
FIG. 11 is a section showing a seventh embodiment of the present invention.

A seventh embodiment of the present invention will be described with reference to FIG. 11. As shown, a color image forming apparatus, generally 1', is similar to the first embodiment except that the photoconductive drums 20Y' through 20Bk', an optical unit 10' and other image forming sections are arranged above an intermediate image transfer belt 60'.

More specifically, the drums 20Y' through 20Bk' and a belt cleaning unit 70' are held in contact with the outer surface of the upper run of the intermediate image transfer belt (simply belt hereinafter) 60'. The optical writing unit 10' is positioned above the drums 20Y' through 20Bk'. At a secondary image transfer position located at one end (right end in FIG. 11) of the belt 60', a toner image formed on the belt 60' by the primary image transfer is transferred to a sheet 2'. The belt 60' and a belt conveyor 81' contact each other at the secondary image transfer position, forming a nip for secondary image transfer. A drive roller 61' and a secondary image transfer roller 64" face each other at the above nip.

A fixing device 80' is positioned above and at the right-hand side of the secondary image transfer nip. The secondary image transfer roller 64" may comprise a core formed of stainless steel (SUS) or similar metal and an urethane or similar elastic layer covering the core and having resistance controlled to $10^6$ Ω to $10^{10}$ Ω by a conductive substance, a roller having rubber hardness (taught in, e.g., Laid-Open Publication No. 10-240027 mentioned earlier) or a roller formed of metal. A positive bias is applied to the secondary image transfer roller 64" at the time of secondary image transfer.

The belt conveyor 81', like the belt conveyor 81 of the first embodiment, is implemented as a single layer of polyimide or similar resin resistive to heat of 160° C. or above, a laminate of polyimide or similar heat-resistant resin layer and a Teflon or similar cover layer or a laminate of a cover layer, an elastic layer and a core layer. The fixing belt 88' is similar in structure to the conveyor belt 81' and passed over each roller by a particular angle.

With the above configuration, the illustrative embodiment achieves the same advantages as the first embodiment.

Eighth Embodiment

Figure 12:
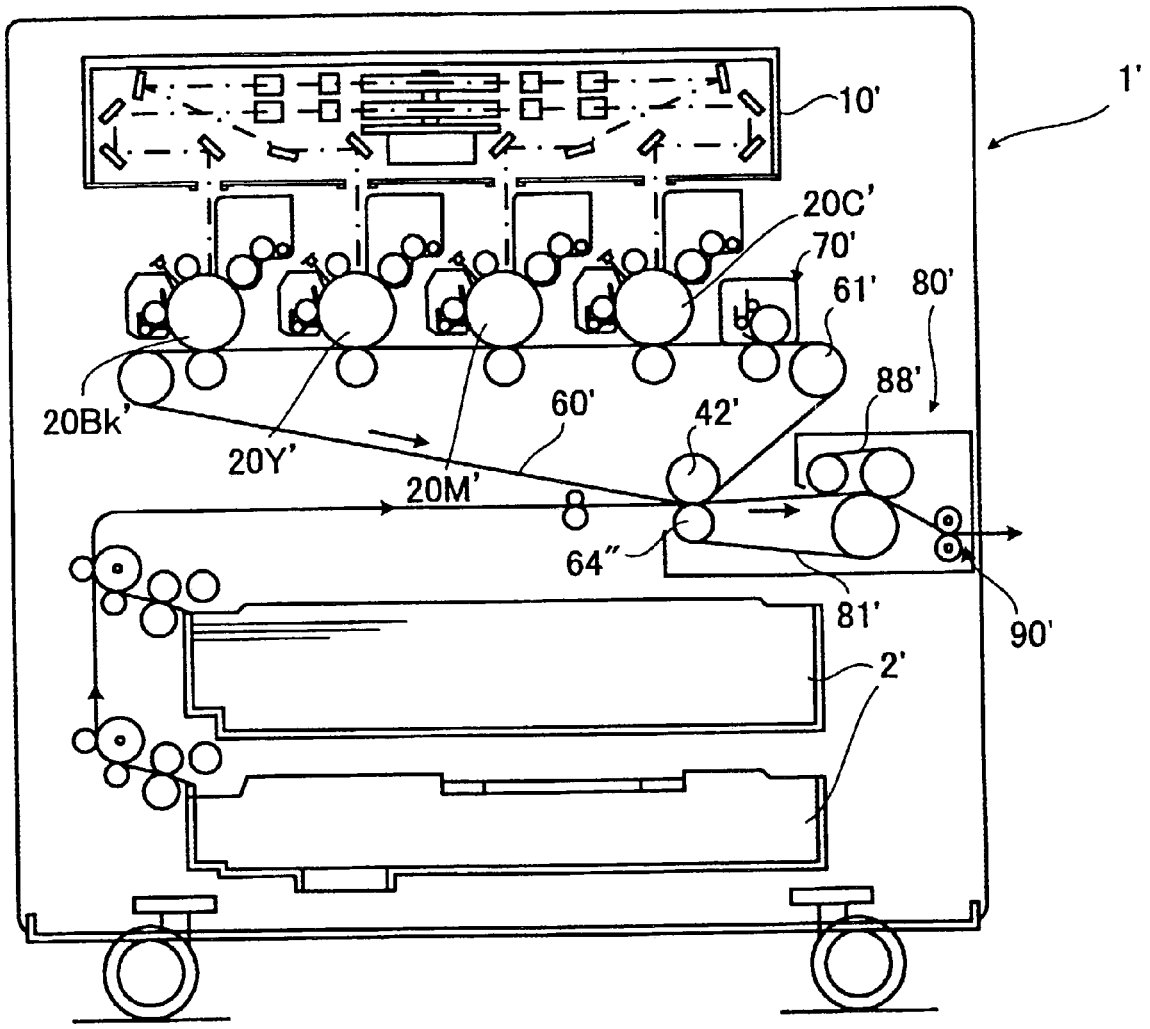
FIG. 12 is a section showing an eighth embodiment of the present invention.

FIG. 12 shows an eighth embodiment of the present invention different from the seventh embodiment in that the fixing device 80' is positioned below the intermediate image transfer belt 60'. As shown, the drums 20Y' through 20Bk' and a belt cleaning unit 70' are held in contact with the outer surface of the upper run of the intermediate image transfer belt (simply belt hereinafter) 60'. The optical writing unit 10' is positioned above the drums 20Y' through 20Bk'. A secondary image transfer position for transferring a toner image from the belt 60' to the sheet 2' is located below the belt 60'. At the secondary image transfer position, the belt 60' and belt conveyor 81' contact each other, forming a nip for secondary image transfer. A roller 42', supporting the belt 60', and the secondary image transfer roller 64" face each other at the above nip.

A negative bias is applied to the roller 42' at the time of secondary image transfer while a positive bias is applied to the secondary image transfer roller 64" at the time of secondary image transfer. The fixing device 80', using the fixing belt 88', is positioned at the right-hand side of the secondary image transfer position, as viewed in FIG. 12. The two belts 81' and 88' contact each other at the secondary image transfer nip.

The belt conveyor 81' is implemented as a single layer of polyimide or similar resin resistive to heat of 160° C. or above, a laminate of polyimide or similar heat-resistant resin layer and a Teflon or similar cover layer or a laminate of a cover layer, an elastic layer and a core layer. The fixing belt 88' is similar in structure to the conveyor belt 81 and passed over each roller by a particular angle.

In the illustrative embodiment, even when the secondary image transfer position is located below the belt 60' in order to prevent the apparatus 1' from increasing in size, the belt conveyor 81' suffices to convey the sheet 2' between the secondary image transfer position and the fixing device 80 alone, so that arrangements for the secondary image transfer and fixation are simplified.

Ninth Embodiment

Figure 13:
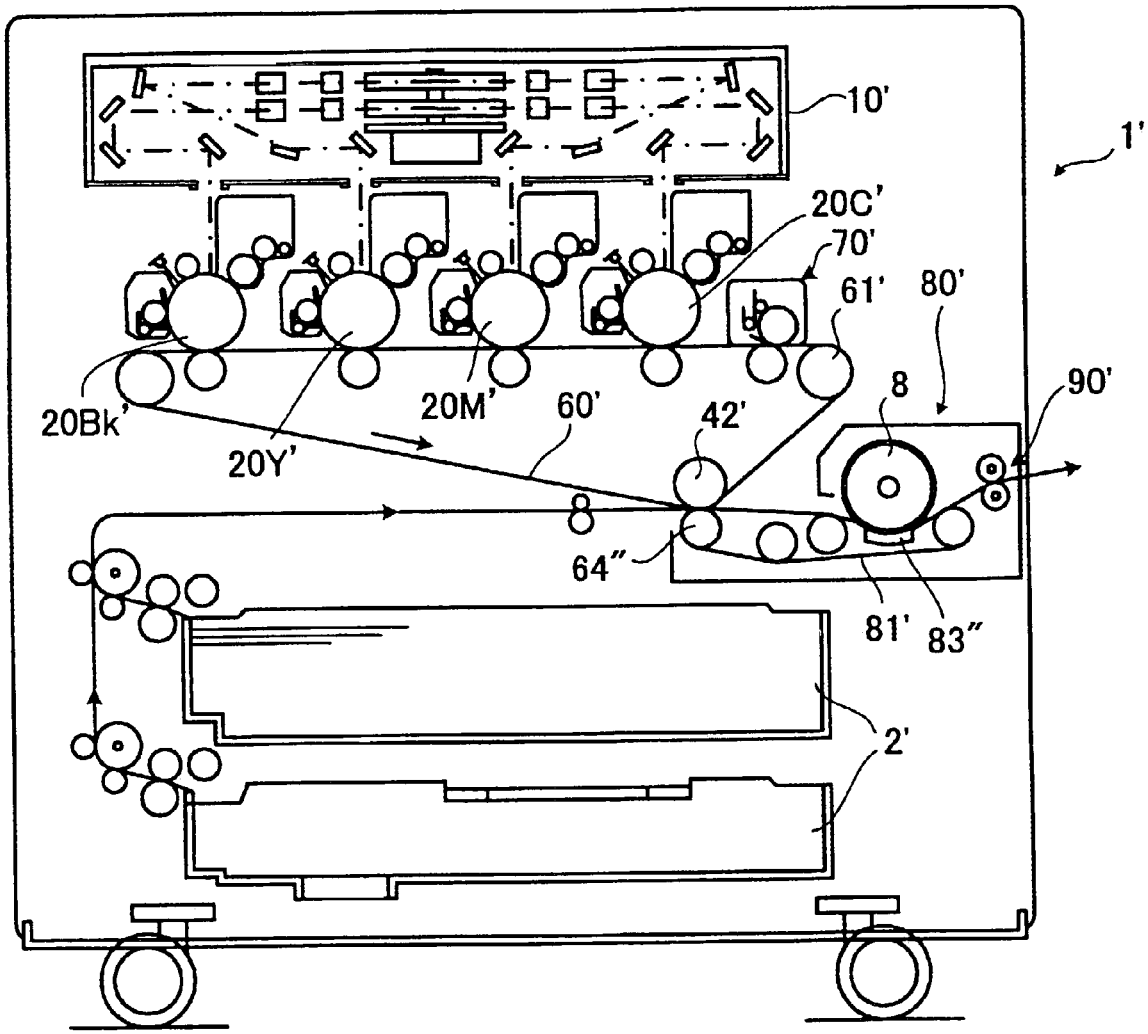
FIG. 13 is a section showing a ninth embodiment of the present invention.

FIG. 13 shows a ninth embodiment of the present invention different from the eighth embodiment in that a fixing roller 8 and an induction heating member or external heating means 83" are provided. The induction heating member 83" faces the fixing roller 8 via the belt conveyor 81'.

As shown in FIG. 13, the drums 20Y' through 20Bk' and a belt cleaning unit 70' are held in contact with the outer surface of the upper run of the intermediate image transfer belt (simply belt hereinafter) 60'. The optical writing unit 10' is positioned above the drums 20Y' through 20Bk'. A secondary image transfer position for transferring a toner image from the belt 60' to the sheet 2' is located below the belt 60'. At the secondary image transfer position, the belt 60' and belt conveyor 81' contact each other, forming a nip for secondary image transfer. A roller 42', supporting the belt 60', and the secondary image transfer roller 64" face each other at the above nip.

A negative bias is applied to the roller 42' at the time of secondary image transfer while a positive bias is applied to the secondary image transfer roller 64" at the time of secondary image transfer. The fixing roller 8 is positioned at the right-hand side of the secondary image transfer position, as viewed in FIG. 13, and held in contact with the belt 81'.

The belt conveyor 81' is implemented as a single layer of polyimide or similar resin resistive to heat of 160° C. or above, a laminate of polyimide or similar heat-resistant resin layer and a Teflon or similar cover layer or a laminate of a cover layer, an elastic layer and a core layer. The fixing roller 8 comprises a hollow, cylindrical, metallic core covered with a heat-resistant resin layer or a core on which a heat-resistant elastic layer and a heat-resistant resin layer are sequentially stacked.

With the above configuration, the illustrative embodiment achieves the same advantages as the eighth embodiment.

Tenth Embodiment

Figure 14:
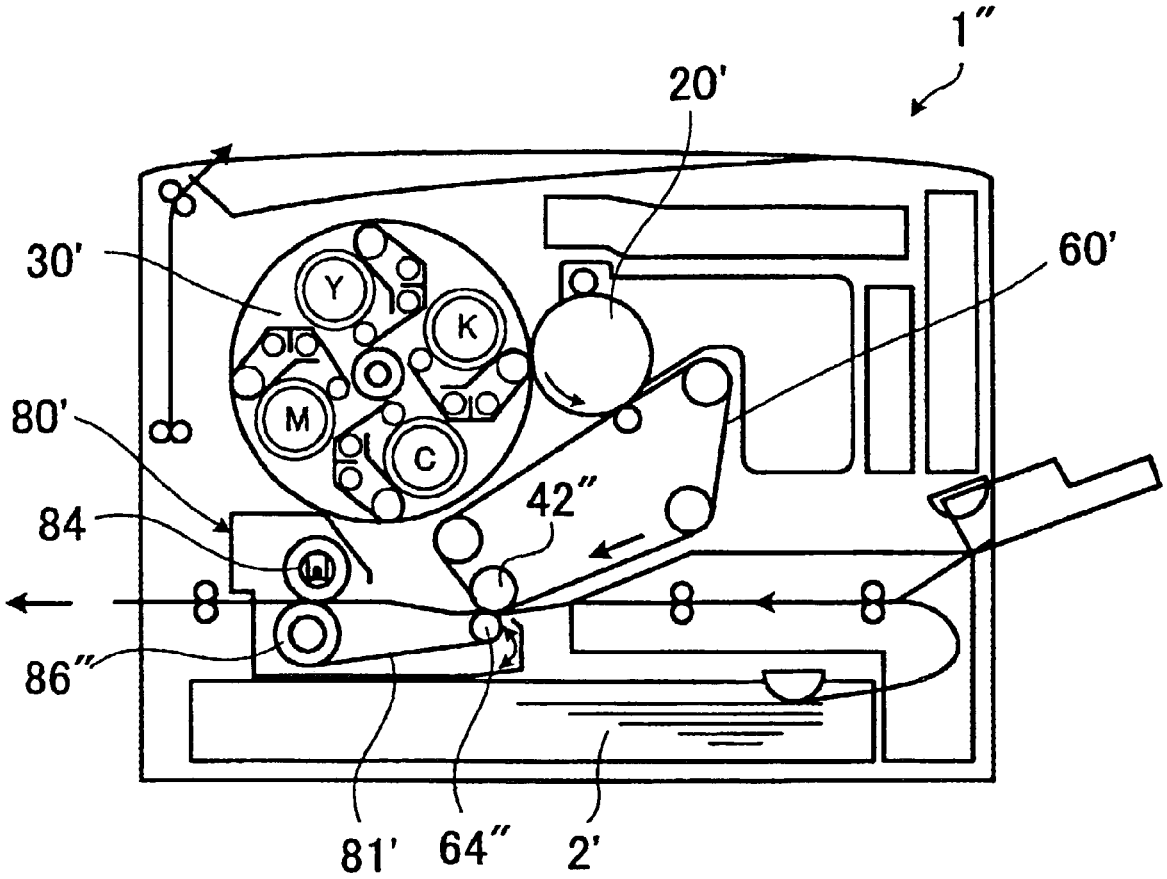
FIG. 14 is a section showing a tenth embodiment of the present invention.

FIG. 14 shows a tenth embodiment of the present invention similar to the first embodiment except for the following. As shown, a color image forming apparatus 1" includes a revolver type developing device 30', a photoconductive drum 20' adjoining the developing device 30', an intermediate image transfer belt 60' contacting the drum 20', and a belt conveyor 81' connecting the belt 60' and heat roller 84. The drum 20' is held in contact with the developing device 30' and belt 60'.

The developing device or toner image forming means 30' sequentially develops latent images sequentially formed on the drum 20' with toner of yellow, magenta, cyan and black toners to thereby produce corresponding toner images. The belt 60' is passed over a plurality of rollers including a tension roller 42" and held in contact with the drum 20' and belt conveyor 81'.

A fixing device 80' includes the heat roller 84 accommodating the heater, a press roller 86", and the belt conveyor 81' passed over a press roller 86" and a secondary image transfer roller 64". The secondary image transfer roller 64" over which the belt conveyor 81' is passed is usually spaced from the belt 60', but brought into contact with the belt 60' in the event of secondary image transfer. Moving means for so moving the secondary image transfer roller 64" is implemented by, e.g., a solenoid, which causes the roller 64" to move upward or downward. At the time of secondary image transfer, a negative bias is applied to a roller 42", which supports the belt 60', while a positive bias is applied to the secondary image transfer roller 64". Further, at the time of fixation, a negative bias is applied to the press roller 86".

Again, the belt conveyor 81' is implemented as a single layer of polyimide or similar resin resistive to heat of 160° C. or above, a laminate of polyimide or similar heat-resistant resin layer and a Teflon or similar cover layer or a laminate of a cover layer, an elastic layer and a core layer. The heat roller 84 comprises a hollow, cylindrical, metallic core covered with a heat-resistant resin layer or a core on which a heat-resistant elastic layer and a heat-resistant resin layer are sequentially stacked.

With the above configuration, the illustrative embodiment simplifies the image transferring device and fixing device while reducing the size of the apparatus 1". In addition, the illustrative embodiment reduces the warm-up time of the fixing device 80' by causing the secondary image transfer roller 64" to move into and out of contact with the belt 60'.

Eleventh Embodiment

Figure 15:
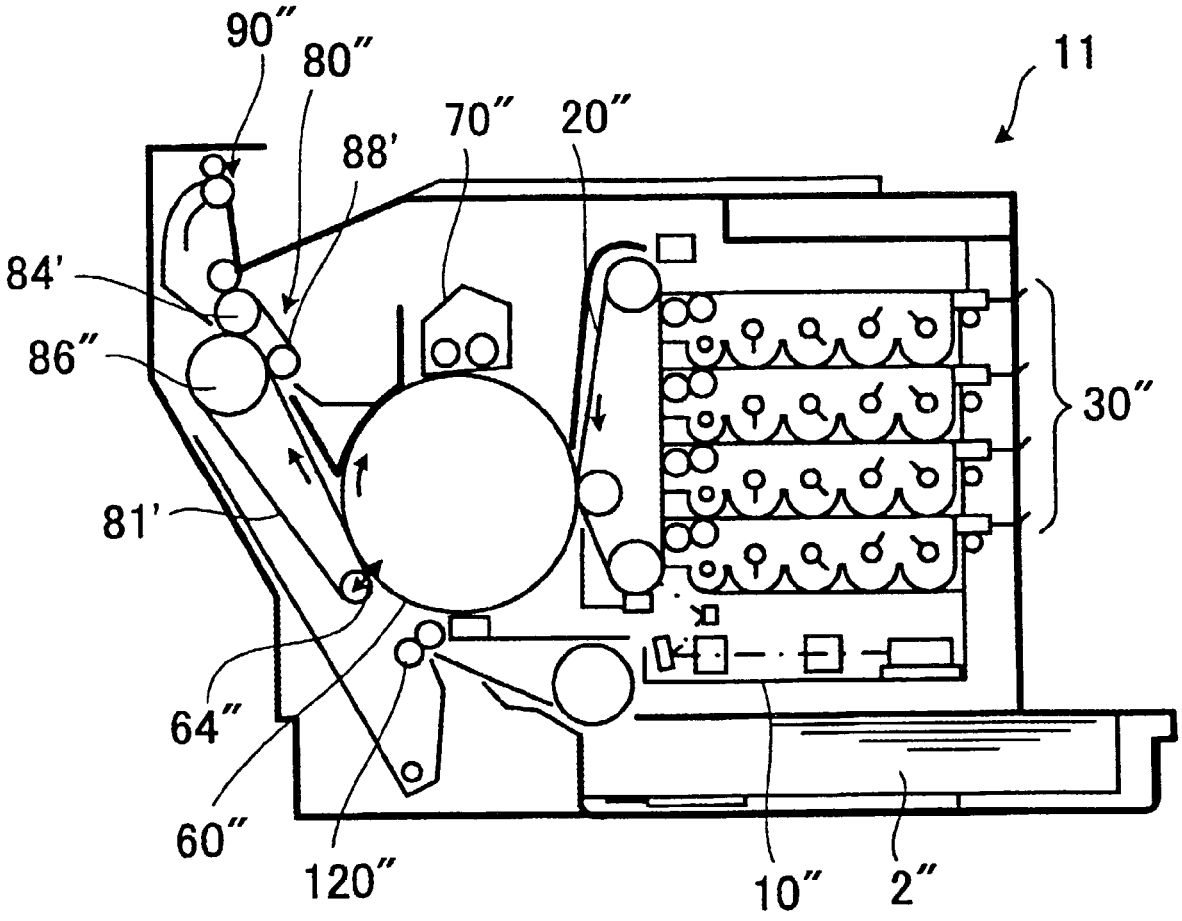
FIG. 15 is a section showing an eleventh embodiment of the present invention.

FIG. 15 shows an eleventh embodiment of the present invention different from the tenth embodiment in that it includes a photoconductive belt 20" and an intermediate image transfer drum 60". As shown, a color image forming apparatus, generally 11, includes the photoconductive belt (simply belt hereinafter) 20" similar to the photoconductive drum 20' in that it is used to sequentially form a yellow, a magenta, a cyan and a black toner image thereon. The belt 20" is held in contact with a developing device 30" and the intermediate image transfer drum (simply drum hereinafter) 60". The developing device 30" includes a Y, an M, a C and a Bk developing sections that develop latent images sequentially formed on the belt 20" with toner of respective colors. An optical writing unit 10" optically scans the belt 20" in accordance with image data to thereby form a latent image on the belt 20".

A registration roller pair 120" positions a sheet 2" fed from a sheet feeding device at a position just preceding the drum 60", which is held in contact with the belt 20" and belt conveyor 81'. A fixing device 80" includes a fixing roller 84', a fixing belt 88' passed over the fixing roller 84' and other rollers, and a belt conveyor 81' passed over a press roller 86" and a secondary image transfer roller 64". The secondary image transfer roller 64" over which the belt conveyor 81' is passed is usually spaced from the drum 60", but brought into contact with the drum 60" in the event of secondary image transfer. The drum 60" and belt conveyor 81' form a nip for secondary image transfer therebetween. At this nip position, the drum 60" and secondary image transfer roller 64" face each other.

Moving means for moving the secondary image transfer roller 64" into and out of contact with the drum 60" is implemented by, e.g., a solenoid. At the time of secondary image transfer, a positive bias opposite in polarity to a toner image formed on the drum 60" is applied to the secondary image transfer roller 64". At the time of fixation, a negative bias is applied to the press roller 86". A sheet discharging device 90" discharges the sheet 2" to the print tray.

Again, the belt conveyor 81' is implemented as a single layer of polyimide or similar resin resistive to heat of 160° C. or above, a laminate of polyimide or similar heat-resistant resin layer and a Teflon or similar cover layer or a laminate of a cover layer, an elastic layer and a core layer. The fixing belt 88' is similar in structure to the belt conveyor 81' and passed over the roller by a preselected angle.

With the above configuration, the illustrative embodiment simplifies the image transferring device and fixing device and reduces the size of the apparatus 11. In addition, by moving the secondary image transfer roller 64" into and out of contact with the drum 60", the illustrative embodiment reduces the warm-up time of the fixing device 80".

In summary, it will be seen that the present invention provides a fixing device simple in configuration and, yet, insures high image quality.

Various modifications will become possible for those skilled in the art after receiving the teachings of the present disclosure without departing from the scope thereof.

What is claimed is:

1. A fixing device comprising:

means for pressing, when a primary transfer toner image produced by transferring a toner image from a photoconductive element to a first image transfer body is to be transferred to a second image transfer body by secondary image transfer, said second image transfer body against said first image transfer body;

means for heating said second image transfer body after the secondary image transfer to thereby fix a secondary transfer image on said second image transfer body;

a press-fixing unit comprising a first press roller configured to press said second image transfer body against said means for heating and a second press roller configured to press said second image transfer body against said means for heating; and means for conveying said second image transfer body from a nip for secondary image transfer between said first image transfer body and said means for pressing to a nip for fixation between said means for heating and said first and second press rollers.

2. The device as claimed in claim 1, wherein said means for conveying comprises an endless belt movable from the nip for secondary image transfer to the nip for fixation.

3. The device as claimed in claim 2, wherein said means for conveying further comprises means for electrostatically retaining said second image transfer body on said endless belt.

4. The device as claimed in claim 3, wherein said means for conveying further comprises means for canceling electrostatic attraction acting on said second image transfer body.

5. An image forming apparatus comprising:

first means for transferring a toner image formed on a photoconductive element to a first image transfer body one time or a plurality of times by primary image transfer;

second means for transferring a primary transfer toner image transferred to said first image transfer body by said first means for transferring to a second image transfer body by secondary image transfer;

a fixing unit comprising means for heating said second image transfer body, a first press roller configured to press said second image transfer body against said means for heating, and a second press roller configured to press said second image transfer body against said means for heating; and means for conveying said second image transfer body from said second means for transferring to said fixing unit.

6. The apparatus as claimed in claim 5, wherein said means for conveying comprises an endless belt movable from a nip for the secondary image transfer to a nip for fixation.

7. The apparatus as claimed in claim 6, wherein said means for conveying further comprises first means for applying a bias, which is opposite in polarity to a bias applied to said first image transfer body for the secondary image transfer, to said endless belt.

8. The apparatus as claimed in claim 7, wherein said first means for applying applies the bias to said endless belt at the same time as the bias for the secondary image transfer is applied to said first image transfer body for thereby assisting said secondary image transfer.

9. The apparatus as claimed in claim 7, further comprising second means for applying a bias, which is opposite in polarity to the bias applied by said first means for applying, to said endless belt conveying said second image transfer body after fixation.

10. The apparatus as claimed in claim 7, further comprising means for grounding said endless belt.

11. A color image forming apparatus comprising:

means for forming, in accordance with image data, a toner image of a particular color on each of a plurality of photoconductive elements;

means for sequentially transferring toner images of different colors formed on said plurality of photoconductive elements to a first image transfer body one above the other by primary image transfer to thereby complete a primary transfer toner image; and a transferring/fixing unit configured to transfer the primary transfer toner image to a second image transfer body by secondary image transfer and to fix said secondary transfer toner image on said second image transfer body, said transferring/fixing unit comprising means for heating a second image transfer body, a first press roller configured to press said second image transfer body against said means for heating, a second press roller configured to press said second image transfer body against said means for heating, and an endless belt configured to convey said secondary image transfer body from a nip for the secondary image transfer to a nip for fixation.

12. The apparatus as claimed in claim 11, wherein said transferring/fixing unit further comprises a first roller facing said first image transfer body and said endless belt is passed over said first, first press, and second press rollers.

13. The apparatus as claimed in claim 12, further comprising first means for applying a bias, which is opposite in polarity to a bias for the secondary image transfer applied to said first image transfer body, to said first roller.

14. The apparatus as claimed in claim 13, wherein said first means for applying applies the bias at the same time as the bias for the secondary image transfer is applied to said first image transfer body for thereby assisting the secondary image transfer.

15. The apparatus as claimed in claim 13, further comprising:

second means for applying a bias, which is opposite in polarity to the bias applied by said first means for applying, to said first press roller; and means for grounding said endless belt in contact with said endless belt.

16. The apparatus as claimed in claim 13, further comprising means for grounding said endless belt in contact with said endless belt.

17. The apparatus as claimed in claim 16, wherein said endless belt is passed over a plurality of rollers including said first, first press, and second press rollers and a third roller positioned downstream of said first roller in a direction of conveyance.

18. The apparatus as claimed in claim 17, further comprising means for heating said endless belt.

19. The apparatus as claimed in claim 12, further comprising means for causing said endless belt and said first image transfer body to selectively contact each other.

20. The apparatus as claimed in claim 12, wherein at least one of the first and second press rollers accommodates means for heating at least one of the first and second press rollers therein.

21. The apparatus as claimed in claim 12, further comprising at least one of first means for heating disposed in any one of said first, first press, and second press rollers and second means for heating positioned outside of the one roller.

22. The apparatus as claimed in claim 12, wherein said second roller consists of two divided rollers facing said first image transfer body.

23. A color image forming apparatus comprising:

means for sequentially forming, in accordance with image data, color toner images on a photoconductive element with toners of a plurality of different colors;

means for sequentially transferring the color toner images from said photoconductive element to a first image transfer body one above the other by primary image transfer to thereby complete a primary transfer toner image; and a transferring/fixing unit configured to transfer the primary transfer toner image to a second image transfer body by secondary image transfer and to fix a secondary transfer toner image on said second image transfer body, said transferring/fixing unit comprising means for heating a second image transfer body, a first press roller configured to press said second image transfer body against means for heating, a second press roller configured to press said second image transfer body against means for heating, and an endless belt configured to convey said second image transfer body from a nip for the secondary image transfer to a nip for fixation.

24. The apparatus as claimed in claim 23, wherein said transferring/fixing unit further comprises a first roller facing said first image transfer body and said endless belt is passed over said first, first press, and second press rollers.

25. The apparatus as claimed in claim 24, further comprising first means for applying a bias, which is opposite in polarity to a bias for the secondary image transfer applied to said first image transfer body, to said first roller.

26. The apparatus as claimed in claim 25, wherein said first means for applying applies the bias at the same time as the bias for the secondary image transfer is applied to said first image transfer body for thereby assisting the secondary image transfer.

27. The apparatus as claimed in claim 25, further comprising:

second means for applying a bias, which is opposite in polarity to the bias applied by said first means for applying, to said first press roller; and means for grounding said endless belt in contact with said endless belt.

28. The apparatus as claimed in claim 25, further comprising means for grounding said endless belt in contact with said endless belt.

29. The apparatus as claimed in claim 28, wherein said endless belt is passed over said first roller, said first press roller, said second press roller and a third roller positioned downstream of said first press roller in a direction of conveyance.

30. The apparatus as claimed in claim 29, further comprising means for heating said endless belt.

31. The apparatus as claimed in claim 24, further comprising means for causing said endless belt and said first image transfer body to selectively contact each other.

32. The apparatus as claimed in claim 24, wherein said at least one of the first and second press rollers accommodates means for heating at least one of the first and second press rollers therein.

33. The apparatus as claimed in claim 24, further comprising at least one of first means for heating disposed in any one of said first and second press rollers and second means for heating positioned outside of the one roller.

34. The apparatus as claimed in claim 24, wherein said second roller consists of two divided rollers facing said first image transfer body.

35. A fixing device comprising:

a conveying belt configured to be held in contact with an intermediate image transfer body to which a toner image is transferred from a photoconductive element and to form a nip for image transfer; and a rotary heating member configured to form a nip for fixation in contact with said conveying belt, a first press roller configured to press said conveying belt against said rotary heating member, and a second press roller configured to press said conveying belt against said rotary heating member.

36. The fixing device as claimed in claim 35, further comprising means for attracting a sheet to said conveying belt.

37. The fixing device as claimed in claim 36, further comprising means for canceling a condition in which the sheet is attracted by said conveying belt.

38. An image forming apparatus comprising a photoconductive element, an intermediate image transfer body to which a toner is transferred from said photoconductive element and a fixing device, said fixing device comprising:

a conveying belt configured to be held in contact with said intermediate image transfer body to thereby form a nip for image transfer, and a rotary heating member configured to form a nip for fixation in contact with said conveying belt, a first press roller configured to press said conveying belt against said rotary heating member, and a second press roller configured to press said conveying belt against said rotary heating member.

39. The image forming apparatus as claimed in claim 38, further comprising means for applying a bias voltage, which is opposite in polarity to a voltage for secondary image transfer supplied to said intermediate image transfer body, to said conveying belt.

* * * * *